US005436530A

United States Patent [19]

Suzuki et al.

[11] Patent Number: 5,436,530

[45] Date of Patent: Jul. 25, 1995

[54] FLAT DISPLAY APPARATUS WITH SUPPLEMENTAL BIASING

[75] Inventors: Ryo Suzuki; Masato Saito; Tetsuya Shiroishi; Takuya Ohira; Yoshiko Fujima; Keiji Fukuyama; Keiji Watanabe, all of Kanagawa, Japan

[73] Assignee: Mitsubishi Denki Kabushiki Kaisha, Tokyo, Japan

[21] Appl. No.: 247,018

[22] Filed: May 20, 1994

Related U.S. Application Data

[63] Continuation of Ser. No. 951,748, Sep. 25, 1992, abandoned.

[30] Foreign Application Priority Data

Oct. 28, 1991 [JP] Japan ..... 3-281324

[51] Int. Cl.[6] ..... G09G 3/10

[52] U.S. Cl. ..... 315/169.1; 315/351; 315/366; 313/422; 313/497

[58] Field of Search ..... 315/169.1, 349, 350, 315/351, 366; 313/422, 497

[56] References Cited

U.S. PATENT DOCUMENTS 4,719,388 1/1988 Oess ..... 315/169.1
4,881,005 11/1989 Morimoto et al. ..... 313/422
4,896,080 1/1990 Tischer et al. ..... 315/366
5,191,259 3/1993 Hayashi et al. ..... 313/422 X

FOREIGN PATENT DOCUMENTS 0213839 3/1987 European Pat. Off. .
0440463 8/1991 European Pat. Off. .
0449284 10/1991 European Pat. Off. .
63-184239 7/1988 Japan .

OTHER PUBLICATIONS

U.S. Ser. No. 07/648,031, Saito, filed Jan. 30, 1991.

*Primary Examiner*—Robert J. Pascal
*Assistant Examiner*—Haissa Philogene
*Attorney, Agent, or Firm*—Wolf, Greenfield & Sacks

[57] ABSTRACT

A flat display apparatus is disclosed which includes a grid interposed between and spaced apart from control electrodes and an electron source. The grid which includes holes has a higher potential applied than the one applied to a cathode so as to enable electrons to pass through the holes. An additional grid may be interposed between and spaced apart from the grid and the control electrodes. Alternatively, a rear electrode is located between adjacent porous cover electrodes to connect them, and a second rear electrode is located near the rear electrode and has a lower potential applied than the one applied to the cover electrodes.

20 Claims, 18 Drawing Sheets

FLAT DISPLAY APPARATUS WITH SUPPLEMENTAL BIASING

This application is a continuation of application Ser. No. 07/951,748, filed Sept. 25, 1992, now abandoned.

BACKGROUND OF THE INVENTION

1. Field of the Invention

The present invention relates to a flat display apparatus utilizing an electron beam.

2. Description of the Prior Art

FIG. 1 is a sectional perspective view showing a part of a conventional flat display apparatus as disclosed in, for example, Japanese Patent Laid-Open Publication No. 91-226949 and No. 91-245445 which are patent applications preceding that made by the assignee of the present invention. In FIG. 1, reference numeral 1 designates a heated wire cathode connected to a support member, the cathode emitting electrons when electric conduction is established. Numeral 2 designates a porous cover electrode having an oval cross-section and a multiplicity of holes, said electrode being adapted to cover the upper surface of the wire cathode 1. The multiplicity of small holes provided in the electrode 2 are for the purpose of passing electrons therethrough. By applying an appropriate potential to the electrode 2, electrons are taken out of the wire cathode 1. An electron source 40 is constructed from the wire cathode 1, the porous cover electrodes 2 and the rear electrode 42 which is adapted to secure the porous cover electrodes arranged in parallel to one another and having the same potential as that of the porous cover electrodes 2.

Numeral 4 designates a front glass with the inside surface coated in a dot-like pattern with three kinds of fluorescent materials 5 which emit red, green and blue lights when excited by the electrons drawn out of the electron source 40 and further formed on the fluorescent materials with aluminum film (not shown) for imparting conductivity. The front glass 4 also constitutes a sealed container 413. By applying a voltage of about 10 to 30 kV to the aluminum film, the electrons are accelerated and excite the fluorescent materials 5 so as to emit light. Numeral 6 designates control electrode section which are disposed between the front glass 4 and the wire cathode 1 so as to allow or inhibit passage of the electrons which are taken out by the porous cover electrodes 2 and directed toward the front glass 4. The control electrode section 6 is constructed by a substrate 8 the surface of which is electrically insulated, such as a glass insulating substrate, and which has aperture corresponding to the pixels on the front glass 4, a first control electrode group 9 which is arranged on the surface of the insulating substrate 8 at the side of the electron source such that each control electrode corresponds to each line of the pixels and consists of strip metal electrodes 9a, and a second control electrode group 10 which is arranged on the surface of the insulating substrate 8 at the side of the fluorescent material such that each control electrode corresponds to each row of the pixels and consists of strip metal electrodes 10a.

Each metal electrode of the first and second control electrode groups 9, 10 respectively is composed, for example, of nickel and each comes in the aperture 7. Some portions of the holes are not applied with the nickel film, thereby providing insulation between the first and second control electrode groups.

The first control electrode group 9 is also provided with the insulating grooves or separation zones 44 not applied with the nickel film in the direction intersecting the wire cathode 1. Similarly, the second electrode group 10 is provided with the separation zones 45 in a direction intersecting the first control electrode group 9 or in a direction parallel to the wire cathode 1. These elements are enclosed by the sealed container 43 the interior of which is maintained under vacuum. The respective electrodes are electrically connected externally through the sealed portion provided at the side wall of the container.

Operation of the apparatus will next be explained. The electrons emitted from the heated wire cathode 1 are taken out by the porous cover electrode 2 which is applied with a positive potential of about 5 to 40 V with an average voltage of the wire cathode 1 as the basis (the average voltage is hereinafter assumed to be 0 V). Further, by applying a positive potential of approx. 20 to 100 V to one of the electrodes in the first control electrode group 9 consisting of metal electrodes 9a arranged in a direction orthogonal to the wire cathode 1, the hot electrons are attracted to this electrode and reach the control electrode section 6. By adjusting the elliptic cylindrical configuration of the porous cover electrode 2, the position of the first control electrode group 9 and the voltage applied to the respective metal electrodes 9a, the electron current density at the front of any one of the metal electrodes 9a in the first control electrode group 9 may be made substantially uniform.

Operation of the control electrode section 6 is as follows. As explained above, if only one of the metal electrodes in the first control electrode group 9 has a positive potential applied (or in ON-condition) while the other electrodes have an 0 V or the negative potential applied (or in OFF-condition), the electrons emitted from the wire cathode 1 are attracted only toward the one metal electrode which is in an ON-condition and enter into one line of the apertures 7 provided in the metal electrode 9a. All the electrons which have entered these apertures 7 will not necessarily pass to the side of the front glass 4. More specifically, the electrons pass only through the apertures of the metal electrodes 10a which are in an ON-condition with, for example, a potential of 40 to 100 V applied out of the second control electrode group 10 provided at the side of the front glass 4 and the electrons do not pass through the apertures 7 of the metal electrodes 10a which are in an OFF condition with an 0 V or a negative potential applied.

Accordingly, electrons are allowed to pass through the apertures at the intersection of one metal electrode 9a which is in an ON condition of the first control electrode group 9 and one metal electrode 10a which is in an ON condition of the second control electrode group 10. Passage of electrons through the holes causes the fluorescent material 5 at the pixel corresponding to the aperture 7 to be illuminated so as to provide a display. In other words, by controlling the potential applied to the respective metal electrodes 9a, 10a so that the intersection as above mentioned may coincide with a desired position, desired pictures may be displayed. For example, each one of the metal electrodes 9a in the first control electrode group 9 is sequentially scanned and caused to be ON. Also, the metal electrode 10A in the second control electrode group 10, which corresponds to the position where the light should be emitted, is caused to be ON with the ON-OFF condition of the second control electrode being synchronized with the ON-OFF condition of the first control electrode. That scanning operation mentioned above is repeated in a cycle which is imperceptible to the human eye, 60 frames per second. In this way, pictures-may be displayed.

The respective control electrodes extend into the apertures 7 for the purpose of inhibiting passage of electrons when the respective control electrodes are applied with a small negative potential in the range of 0 V to some 10 volts, such that the electrons which have entered the apertures may be effectively provided with electric fields.

The luminance of each pixel is controlled by the time for which each metal electrode 10a of the second control electrode group 10 is ON. Specifically if it is assumed that the time for which one electrode of the first control electrode group 9 is ON is $t_y$, and if the luminance of the pixel at a position is intended to be P %, the time $t_x$ for which the metal electrode 10a of the second control electrode group 10 which corresponds to that position is ON is set at $P \times t_y/100$.

In such a conventional flat display apparatus, since the metal electrodes which are ON in the first control electrode group 9 is just in the order of one, most of the electrons which have been drawn by the porous cover electrode 2 from the wire cathode 1 will be returned to the side of the electron source due to the negative potential of the metal electrodes which are off, resulting in quite a few electrons which can reach the metal electrodes which are on. This has resulted in such problems as excess consumption of power and insufficient luminance.

SUMMARY OF THE INVENTION

Accordingly, it is an object of the present invention to eliminate the above-described problem in the related art and to provide a flat display apparatus which reduces consumption of unnecessary power and provides a sufficient luminance by allowing the electrons which have passed through the porous cover electrode to contribute to effective light emission.

To achieve the object, a flat display apparatus according to the present invention comprises;

a sealed container kept under vacuum, a light emitting means provided in said sealed container, an electron source provided in said sealed container, having a cathode and a porous cover electrode, and emitting electrons spread toward said light emitting means, a substrate interposed between said electron source and said light emitting means, said substrate including at least an electrically insulated surface, a plurality of apertures allowing a plurality of electrons emitted from said electron source to pass therethrough, and a plurality of control electrodes which are applied with the passing electron control potential allowing the electrons to selectively pass through said apertures and an electrically conductive grid means interposed between and spaced from said control electrodes and said electron source and including a plurality of apertures allowing the electrons emitted from said electron source to pass therethrough, said grid means being applied with a high potential than the one applied to said cathode.

Since a grid means which is interposed between and spaced from the control electrodes and the electron source and includes a plurality of apertures in the conductor thereof is provided, most of the electrons which have passed through the porous cover electrodes are drawn together with the flow of electrons being uniformed by the grid means and electrons are taken out immediately before the control electrode, so that they may reach the control electrodes which are on before they are compelled to return toward the electron source due to the negative potential of the control electrodes which are off, whereby electrons may be more effectively utilized and the power consumption may be reduced while the luminance may be enhanced.

According to an embodiment of a flat display apparatus of the present invention, an electrically conductive additional grid means is interposed between and spaced from the grid means and the control electrodes, said additional grid means including a plurality of apertures allowing the electrons emitted from the electron source to pass therethrough and being applied with a higher potential than the one applied to the cathode.

By providing said additional grid means which is interposed between and spaced from said grid means and said control electrodes and which includes a plurality of apertures; in the conductor thereof, after the flow of electrons is uniformed by the grid means applied with an appropriate voltage and after the electrons are accelerated by the additional grid means applied with the voltage suitable for enabling the electrons to come to the position of the control electrodes which are on, the electrons: are taken out before the control electrode, such that the possibility rate of the electrons coming to the control electrodes which are on may be increased, whereby such an effect as reduction of power consumption and increase of luminance may be provided.

According to another embodiment of a flat display apparatus of the present invention, the apertures of said grid means are positioned such that the apertures of the substrate are included in the apertures of the grid means in the direction from the grid means toward said substrate, and the distance between the control electrodes of the substrate and the grid means is equal to or less than twice of the distance between the adjacent apertures of the substrate.

Accordingly, the tendency of electrons being returned toward the electron source due to the negative potential of the control electrodes which are off may be further reduced while the non-uniform display due to the shadow of the grid means is kept small. Further by setting the distance between said control electrodes of the substrate and said grid means to be small, the utilization efficiency of electrons may be further increased, resulting in further reduction of power and increase of luminance.

According to a further embodiment of a flat display apparatus of the present invention, the portion of the grid means in the vicinity of said cathode is curved so as to be convex toward said cathode.

Accordingly, the path of the electrons which have come to the side surface of the porous cover electrode may be changed to a more vertical direction and the electrons, after having passed through the grid means, may be incident in a more vertical direction upon entering the apertures of the substrate, whereby passage rate of the electrons through the apertures may be increased. As a consequence, utilization efficiency of the electrons may further be increased, resulting in further decrease of power consumption and increase of luminance.

According to a still further embodiment of a flat display apparatus of the present invention, the cathode is a wire cathode, a plurality of sets of the cathode and the porous cover electrode are arranged in parallel with one another, the plurality of control electrodes of the substrate are electrically separated from one another and a part of the control electrodes is arranged in parallel with the wire cathode, and the plurality of spaces between the porous cover electrodes and the cathodes are so selectively applied with potential in such a way that electrons are allowed to be emitted only from a few of the wire cathodes of which distance to the control electrodes which are (been) selectively applied with the passing electron controlling potential out of said part of said control electrodes is near.

Since the emission amount of electrons necessary for display may be limited, utilization efficiency of the electrons may be further improved, resulting in further decrease of power consumption and increase of luminance.

According to a still further embodiment of the present invention, a plurality of the cathodes and the porous cover electrodes are spaced from one another, additional electrodes electrically insulated from the porous cover electrodes are respectively disposed between the adjacent cover electrodes, and said additional electrodes are electrically connected to one another and applied with a potential lower than the one applied to the porous cover electrodes.

Provision of the additional electrodes causes the electrons which have passed through the porous cover electrodes to change the path in the direction of the control electrodes and enter the apertures thereof in substantially vertical direction after having passed through the grid means, whereby utilization efficiency of electrons may be further increased, resulting in a further reduction of power consumption and increase of luminance.

Still further embodiment of a flat display apparatus according to the present invention comprises;

a sealed container kept in vacuum, a light emitting means provided in said sealed container, electron sources provided in said sealed container and respectively having a set of a cathode and porous cover electrode which are spaced apart from one another, said electron sources emitting electrons spread toward said light emitting means, a rear electrode located between the adjacent porous cover electrode and connecting said porous cover electrode to each other, a substrate interposed between said electron source and said light emitting means, said substrate including at least an electrically insulated surface, a plurality of apertures allowing a plurality of electrons emitted from said electron sources to pass therethrough, and a plurality of control electrodes which are applied with the passing electron control potential allowing the electrons to selectively pass through said apertures, and an additional electrode located in the vicinity of said rear electrode at the side of said substrate, electrically insulated from said rear electrode and said porous cover electrodes, and applied with a lower potential than the one applied to said porous cover electrode.

By applying an appropriate potential to the additional electrode so that the path of the electrons which have passed through the porous cover electrodes may be changed to the direction vertical relative to the control electrodes, the tendency of electrons being returned to the electron source due to the negative potential due to, for example, the control electrodes which are off may be reduced while the passage rate of the electrons through the apertures of the control electrodes may be increased, whereby utilization efficiency of electrons may be increased, resulting in lower power consumption and higher luminance.

The above and other objects, features and advantages of the present invention will become clear from the following description of the preferred embodiments thereof, taken in conjunction with the accompanying drawings.

DETAILED DESCRIPTION OF THE PREFERRED EMBODIMENTS

Embodiment 1

Figure 1:
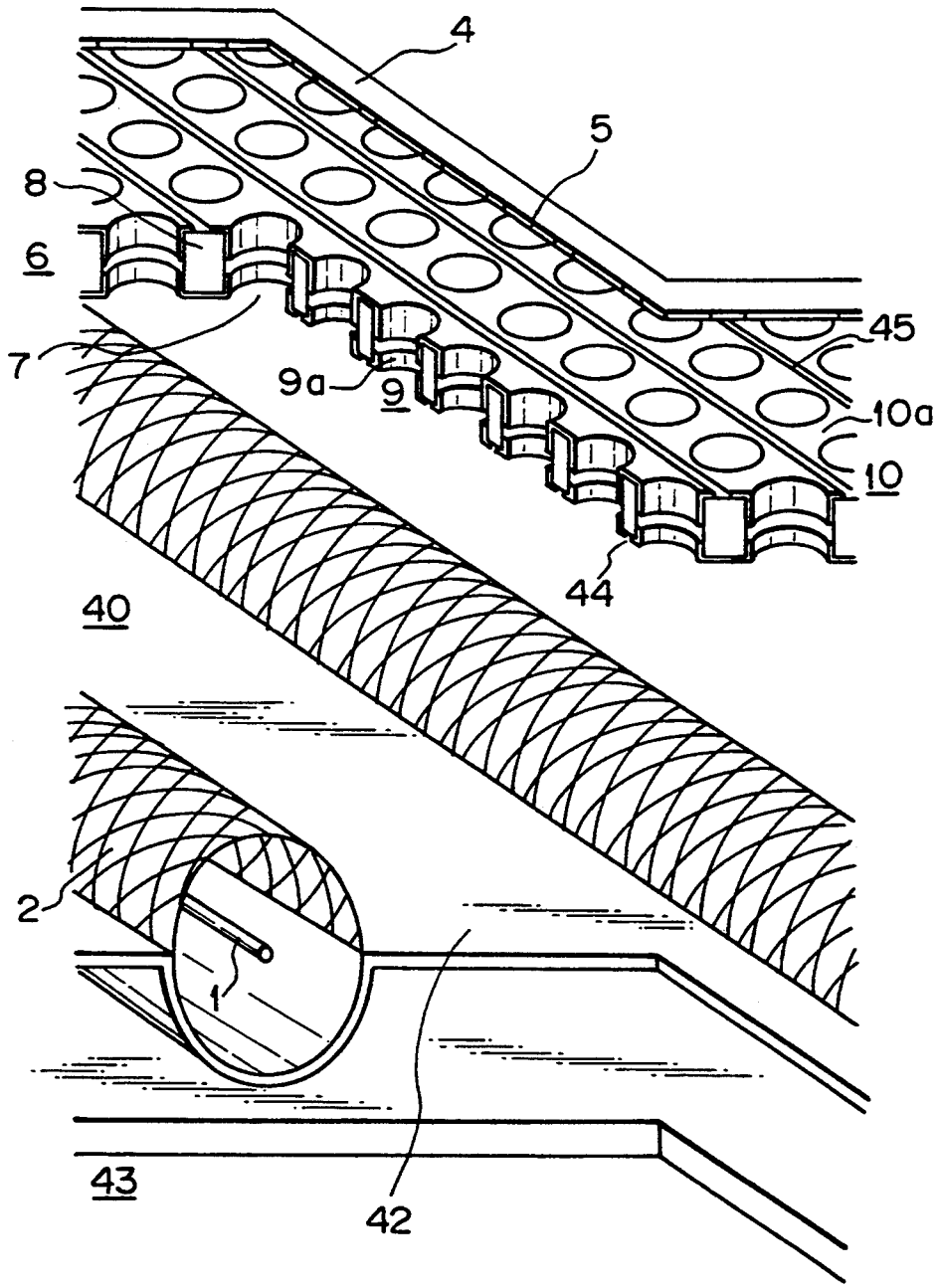
Fig. 1 (PRIOR ART)
FIG. 1 is a sectional perspective view showing a flat display apparatus according to a prior art.
Figure 2:
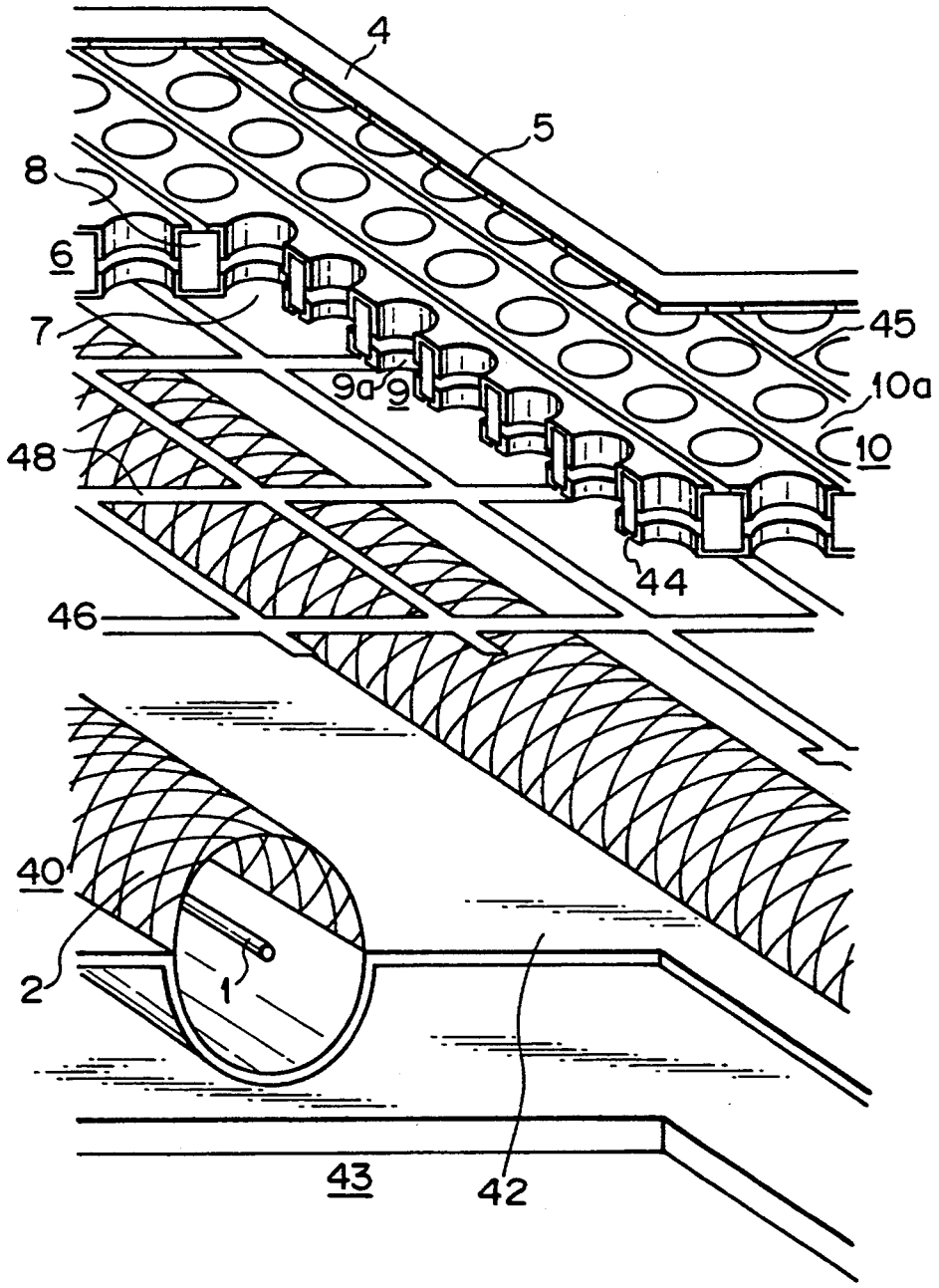
FIG. 2 is a sectional perspective view showing a flat display apparatus according to the present invention.
Figure 3:
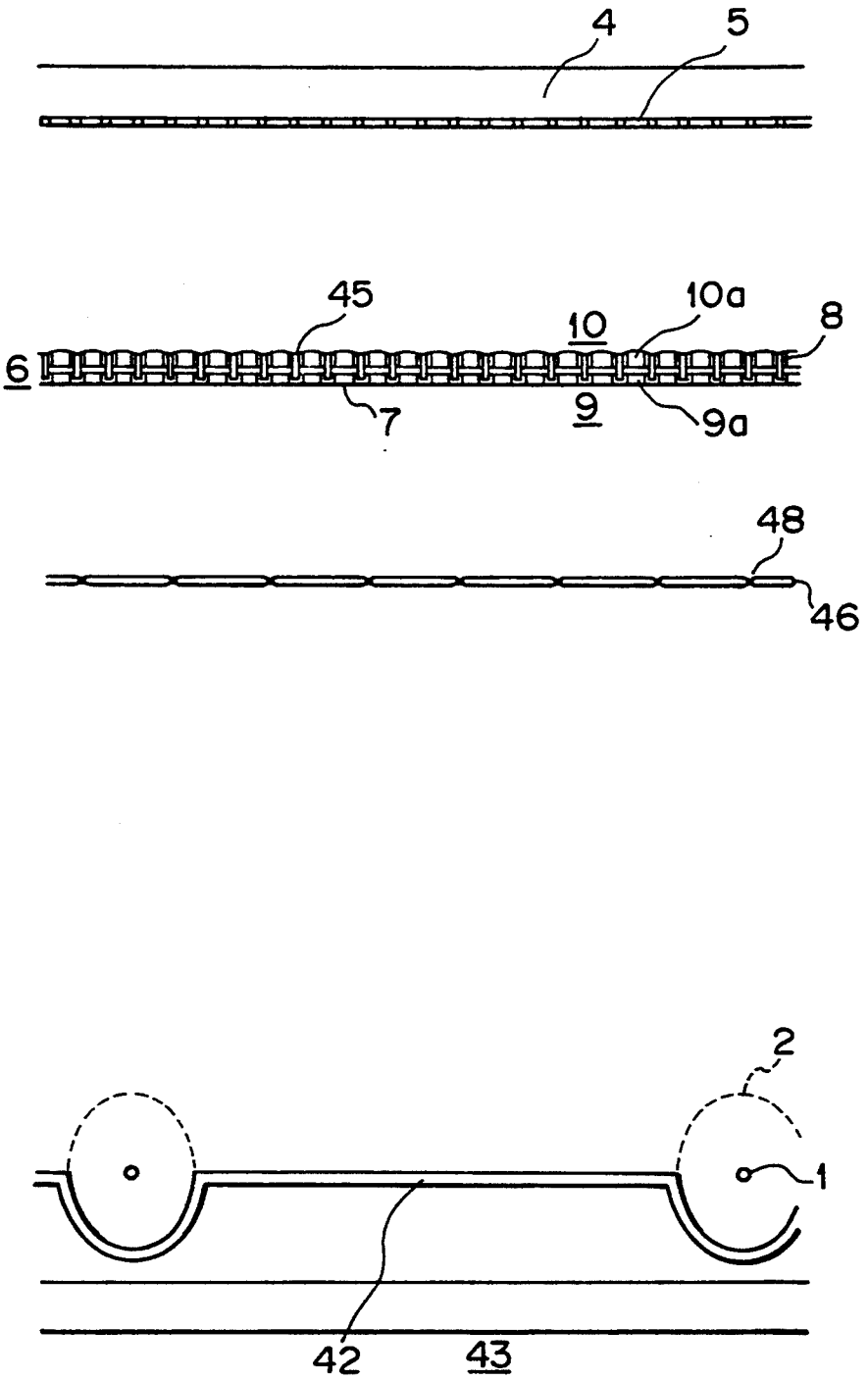
FIG. 3 is a sectional front view showing a flat display apparatus illustrated in FIG. 2.

Embodiments of the present invention will now be explained with reference to the accompanying drawings. FIG. 2 and FIG. 3 are respectively a sectional perspective view and a sectional front view of a part of the flat display apparatus according to an embodiment of the present invention. Reference numeral 46 designates a second grid which is made of a metallic sheet such as a stainless steel sheet perforated by means of an etching process. In this embodiment, square holes each having sides of 1.8 mm and perforated in a grid configuration with a pitch of 2 mm, the percentage of perforations being 81% so as to allow as great a number of electrons to pass therethrough as possible. The second grid 46 is located between and spaced from the electron source 40 and the first control electrode group 9. The distance from the rear electrode 42 to the first control electrode group 9 is 20 mm while the distance from the second grid 46 to the first control electrode group 9 is 5 mm. In this embodiment, the distance between the adjacent wire cathodes 1 is 20 mm while the pitch between the pixels or the apertures 7 is 0.6 mm. Constituents other than those mentioned above are the same as those of the conventional apparatus shown in FIG. 1.

Potentials, for example, of 20 V, 25 V, 60 V and −4 V are applied to the porous cover electrodes 2, the second grid 46, the metal electrodes 9a which are on of the first control electrode group 9 and the electrodes which are off of the same control electrode group 9, respectively. For this reason, the electrons emitted from the wire cathodes 1 obtain the kinetic energy of 20 eV and pass through the porous cover electrodes 2. Most of the electrons which have thus passed through the porous cover electrodes 2 are drawn by the second grid 46 to spread toward the second grid 46 by changing their trajectories upwardly as viewed in the drawing of FIG. 2. Near the second grid 46 at the side facing the cover electrodes 2, the upward component of the velocity of the electron in the drawing of FIG. 2 becomes larger while the electron current density becomes substantially uniform. Most of the electrons which have passed through the second grid 46 and are then directed to the metal electrodes which are off in the first control electrode group 9 are pushed back to the side of the second grid 46 due to the negative potential. On the other hand, those electrons which are directed to the metal electrode 9a which is on in the first control electrode group 9 arrive at such metal electrode 9a which is on and may pass through the apertures 7 in accordance with an on-off operation of the second control electrodes 10a and be utilized to cause the fluorescent element 5 to emit light. The utilization efficiency of electrons can be outstandingly increased as compared to a prior art especially when the electron current density is large.

In order to make the electron current density uniform, the distance between the porous cover electrode 2 and the second grid 46 needs to be more than half of the distance between the wire cathodes 1 and it is good enough if it is more than the latter distance. Also, the longer the distance between the wire cathodes 1, the less the total electric power consumption for heating the wire cathodes 1 is required. Then the construction may also be simpler and manufacture may be easier. Therefore, the distance between the porous cover electrode 2 and the second grid 46 needs to be extended.

The smaller is the distance L between the second grid 46 and the first control electrode group 9, the greater is the number of electrons which reach the metal electrode 9a which is on in the first control electrode group 9. If the electron current density at the second grid 46 is small, the distance L does not greatly affect the number of electrons which reach the metal electrodes 9a which is on. However, when the electron current density is increased, said affect by the distance L becomes outstanding. In the case of the distance L being 20 mm, the number of electrons $N_{on}$ which reach the control electrode 9a which is on is proportional to the electron current density as far as the electron current density amounts up to 0.1 mA/cm$^2$. If the electron current density exceed 0.15 mA/Cm$^2$, said number of electrons is not proportional but decrease. As far as such proportion is observed, $N_{on}$ is not so much affected even if the distance L is varied. However, as the distance L is made smaller, the upper limit of the electron current density in the range in which $N_{on}$ is proportional to the electron current density increases. For example, if the distance L is set to be 5 mm, the above-mentioned proportion is maintained up to the electron current density of 0.6 mA/cm$^2$. As the consequence, in the case of the electron current density being 0.6 mA/cm$^2$, the number of electrons which reach the metal electrode which is ON in the case of the distance L being 5 mm is about ten times as many as that where the distance is 10 mm.

The above-described phenomena arise for the following reasons. Since most of the electrodes in the first control electrode group 9 are off, most of the electrons do not reach the first control electrode group 9 but are drawn back to the second grid 46. The velocity of the electrons is quite low in the course of those electrons being drawn back, with the electron density being larger in certain areas. In this way, as the electron current density is increased, the electron density is also increased, whereby even such electrons having a trajectory to enable them to reach the metal electrode which is ON are drawn back to the second grid 46 under the negative charge of the electrons. As a consequence, the number $N_{on}$ of the electrons reaching the metal electrode which is on is not proportional to the metal electrodes which is current density. If the distance L is made smaller, the electric field between the second grid 46 and the first control electrode group 9 becomes stronger and the area in which the electron density is increased becomes smaller, such that the value of the electron current density under which the number of electrons reaching the metal electrode which is on is no more proportional to the electron current density increases.

Inn the constitution of a prior art, if the distance between the rear electrodes 42 or the porous cover electrode 2 and the first control electrode group 1 is sufficiently small, the upper limit of the electron current density in the range in which the above-mentioned proportion is observed is also increased. However, due to the fact that the electrons are not sufficiently spread, the electron current density is non-uniform.

If the distance L is made small, the upper limit of the electron current density in the range in which the above-mentioned proportion is observed is increased. However, if the distance L is made too small, the electron current is not uniform corresponding to the shadow of the bridge portions 48 of the second grid 46.

In this regard, it is preferable for the distance L to be more than five times the pitch between the apertures 7.

If the potential applied to the second grid 46 is made high, the upper limit of the electron current density in the range in which the above-mentioned proportion is observed is increased. As far as the electron current density is in the range in which the above-mentioned proportion is observed is concerned, the most optimum value of the potential of the second grid 46 for utilization efficiency of electrons is slightly higher than the potential of the porous cover electrode 2. As the potential of the second grid 46 is further increased, the utilization efficiency of electrons is slightly lowered. Since, if the potential of the second grid 46 is higher, the electric power consumption at the second grid 46 is increased, it is preferable for the second grid 46 to be applied with the potential which enables a desired electron current density to be obtained.

Embodiment 2

Figure 4:
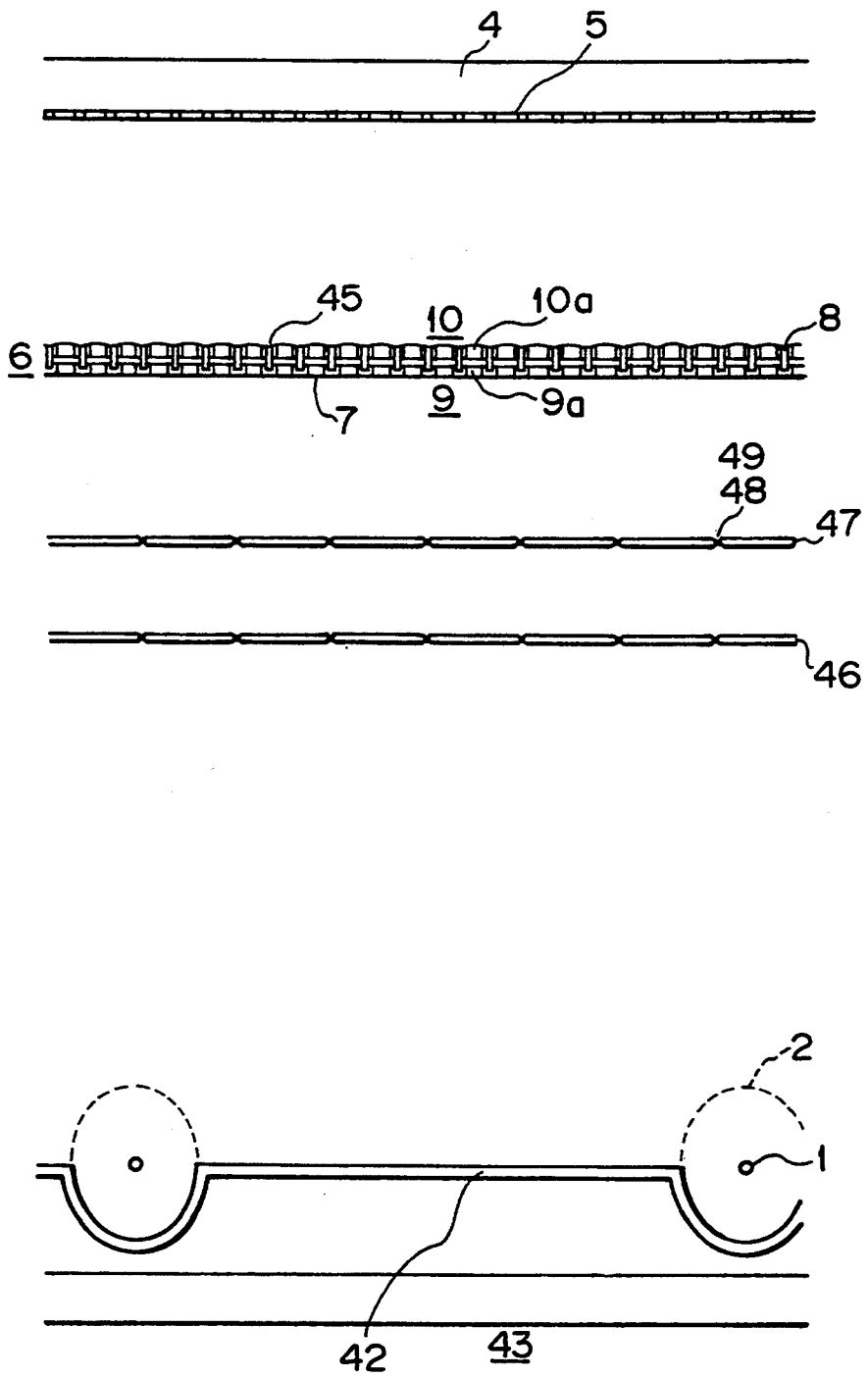
FIG. 4 is a sectional front view showing a flat display apparatus according to another embodiment of the present invention.

FIG. 4 is a sectional front view of a part of a flat display apparatus according to another embodiment of the present invention. Reference numeral 47 designates a third grid interposed between a first control electrode group 9 and a second grid 46, the third grid being made of a metal sheet, for example, a stainless steel sheet having a thickness of 0.2 mm perforated with square holes having each side of 1.8 mm and the pitch of 2 mm. The distance between a rear electrode 42 and the first control electrode group 9 is 23 mm, the distance between the rear electrode 42 and the second grid 46 is 15 mm, and the distance between the second grid 46 and the third grid 47 is 3 mm. In the illustrated example, a potential of 20 V is applied to a porous cover electrodes 2 and the rear electrode 42, potential of 25 V is applied to the second grid 46, and potential of 120 V is applied to the third grid 47.

In the illustrated example, since the potential applied to the second grid 46 is so selected as to be most optimum for spreading electrons uniformly, the electrons which have passed through the porous cover electrodes 2 are allowed to spread uniformly and reach the second grid 46. Then, the electrons are accelerated by the third grid 47 to 120 eV and pass through the third grid 47. As described earlier, in the range wherein the number of electrons $N_{on}$ reaching the metal electrode 9a of the first control electrode group 9 which is on is proportional to the electron current density at the grid facing the first control electrode group 9 (which corresponds to the third grid 47 in this embodiment and corresponds to the second grid 46 in the embodiment 1), the number of electrons reaching the metal electrode 9a which is on slightly becomes smaller if the potential of the grid is increased. However, that proportional range is rather wide as compared to that of the embodiment 1. In the embodiment 1, the number of electrons reaching the ON-metal electrode 9a is proportional to the electron current density as far as 0.6 mA/cm$^2$ in the case of the distance L being 5 mm. In contrast to this, in the embodiment 2, such proportion is provided even at 2.0 mA/cm$^2$. Accordingly, in order to attain a high luminance, the number of electrons reaching the metal electrode 9a which is on, or the luminance according to the present embodiment is about three times as high as that of the embodiment 1 when compared on the basis at the electron current density of 1.0 mA/cm$^2$. This means that the present embodiment is more effective.

If the luminance is sufficient but power consumption is desired to be reduced, only a low voltage, for example, 15 V may be applied to the third grid 47. In this way, the second grid 46 may have a potential applied which is optimum for making the electron current uniform and the third grid may have a potential applied which is optimum in respect of luminance or power consumption.

Embodiment 3

Figure 5:
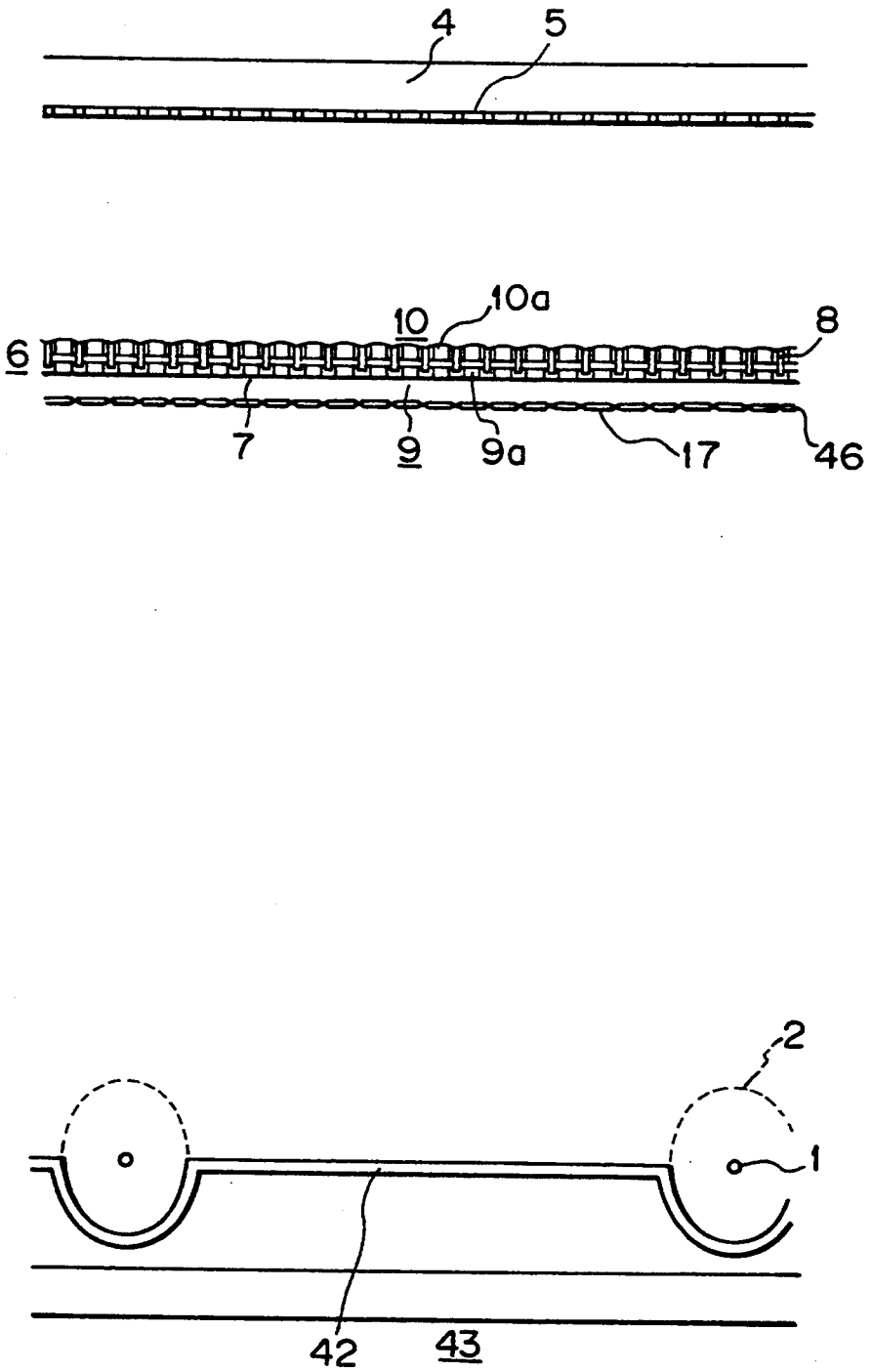
FIG. 5 is a sectional front view of a flat display apparatus according to a further embodiment of the present invention.

FIG. 5 is a sectional front view of a part of a flat display apparatus according to a further embodiment of the present invention. Reference numeral 46 designates a second grid made of a metal sheet, for example, a stainless steel sheet having a thickness of 0.2 mm and formed with square holes 17 having each side of 0.45 mm and the pitch of 0.6 mm. The distance L between the second grid 46 and a first control electrode group 9 is 0.5 mm and the central axis of the square hole 17 coincides substantially with the central axis of the apertures 7.

According to this embodiment, since the distance L is so small that the range in which the number $N_{on}$ of the electrons reaching the control electrodes which are on is proportional to the electron current density at the second grid 46 is wide. This proportionality is maintained even at the electron current density of 2.0 mA/cm$^2$. Since the pitch and the central axis of the square holes 17 provided in the second grid 46 and the apertures 7 are coincided with one another, even if the second grid 46 is brought closer to the control electrodes 9a, the shadow of the bridge portions 48 (see FIG. 2) interferes with only the edge of the apertures 7, whereby non-uniformity of the electron current will rarely be caused.

The condition under which non-uniformity of the electron current is not caused is that the holes 17 provided in the second grid 46 are aligned with the apertures 7 as well as the distance being short. This is because, since the trajectories of the electrons are slanted between the wire cathodes 1 and the second grid 46, the shadow of the bridge portions 48 may be formed near the center of the apertures 7 if the distance L is considerable even if the holes in the second grid are aligned with the apertures 7. Observation of the relationship between the distance L and the non-uniformity of the electron current has revealed that if the distance L is less than two times of the pitch between the apertures 7 of the control electrodes, non-uniformity of the electron current is so small that non-uniformity of luminance does not cause problems. The reason for spacing the second grid 46 from the control electrodes 9a instead of tightly contacting them is that if they are tightly contacted, an insulating film which needs a complicated manufacturing is required for being provided therebetween and that the exposed area of the metal electrodes 9a is reduced so that higher control potential for the passing electrons is required in order to accurately control passage of electrons.

Figure 6:
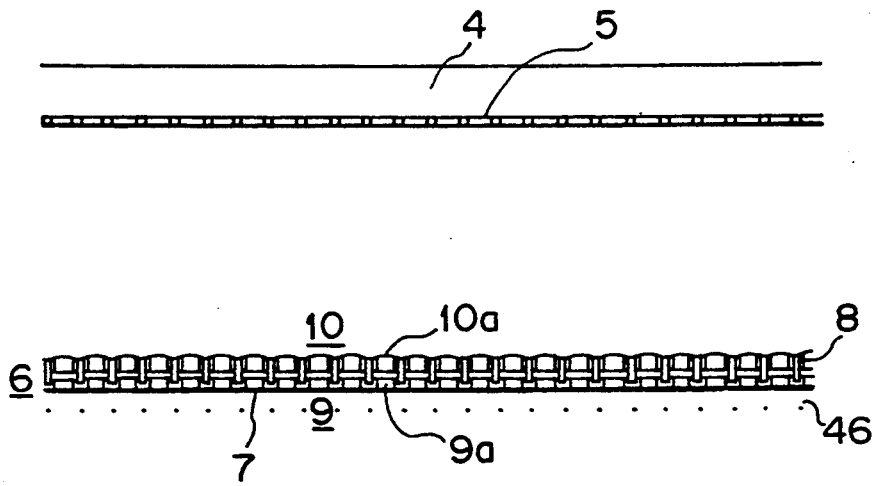
FIG. 6 is a sectional front view of a flat display apparatus according to a still further embodiment of the present invention.
Figure 6:
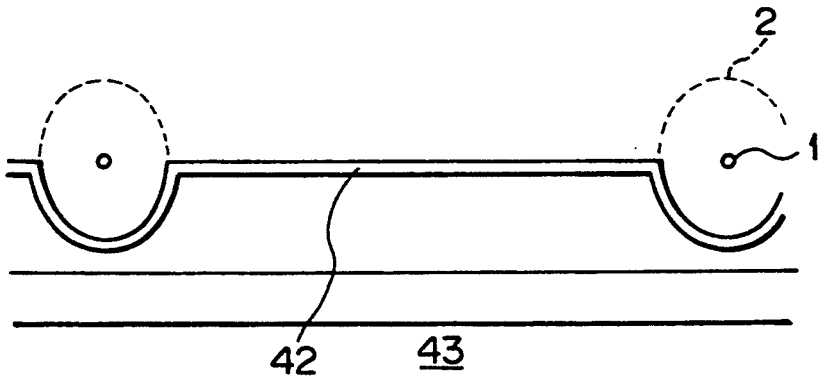

If the bridge portions 48 of the second grid 46 are provided in such a position as not to interfere with the apertures 7, it is not necessary to coincide with the pitches and the central axes of the holes 17 of the second grid 46 and the apertures 7. For example, the pitch of the holes 17 in the second grid 46 is set to be two times of the pitch of the apertures 7 so that the bridge portions 48 of the second grid 46 may be located at the position where no apertures 7 are present. A similar effect may be attained if the second grid 46 is formed by use of metallic wire having a diameter of 0.05 mm, for example, to be stretched in parallel to one another with the pitch being integer times of the pitch of the apertures 7 over the portions where no apertures 7 are present, as shown in FIG. 6.

Embodiment 4

Figure 7:
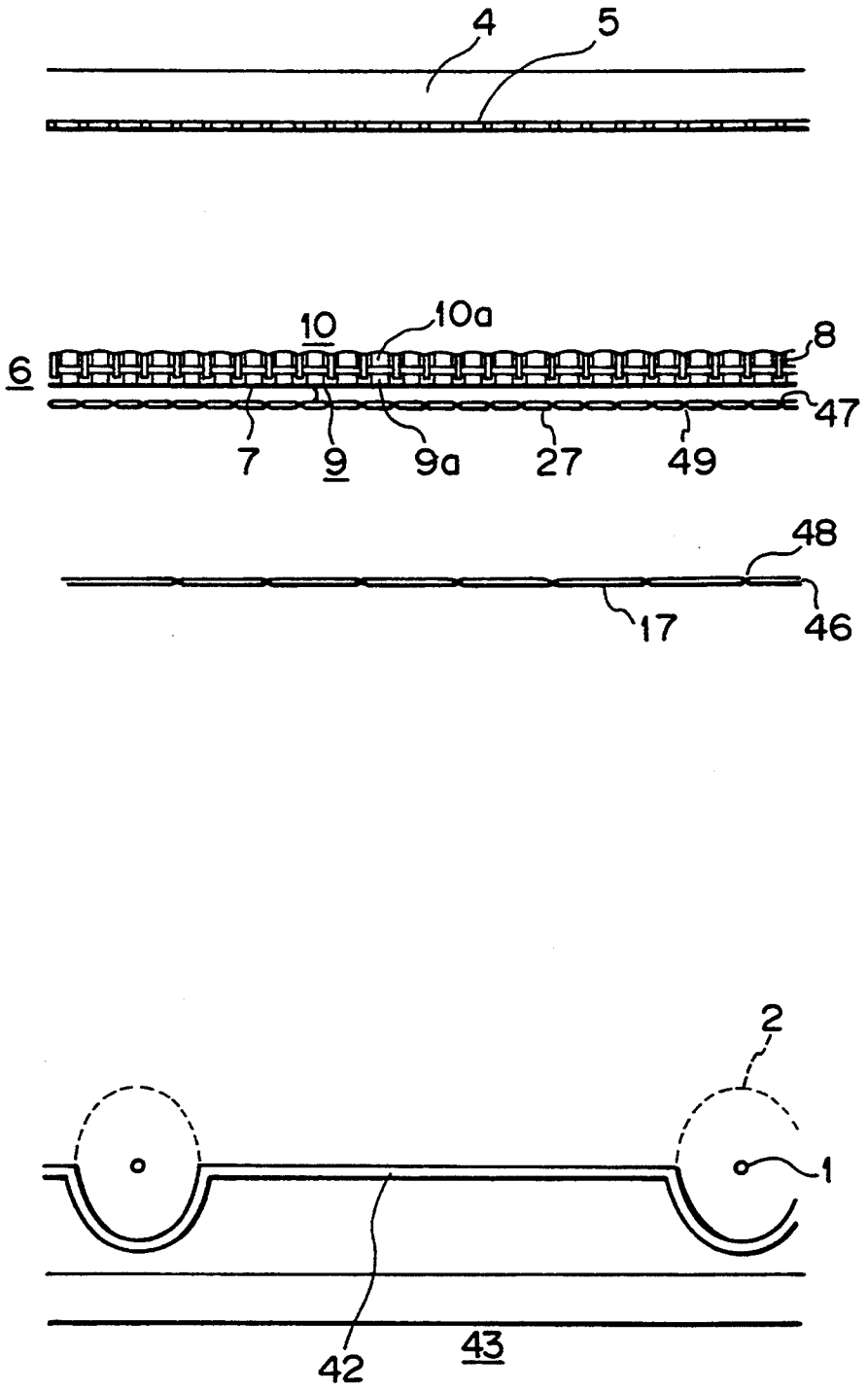
FIG. 7 is a sectional front view of a flat display apparatus according to a yet further embodiment of the present invention.

FIG. 7 is a sectional front view of a part of the flat display apparatus according to a still further embodiment of the present invention. Reference numeral 47 designates a third grid made of a metal sheet, for example, a stainless steel sheet having a thickness of 0.2 mm and formed with square holes 27 having a pitch of 0.6 mm and each side of 0.45 mm. The distance L between the third grid 47 and the first control electrode group 9 is 0.5 mm. The central axis of the square holes 27 substantially coincides with the central axis of apertures 7 having the same pitch as that of the square holes 27. Reference numeral 46 designates the second grid made of a stainless steel sheet having a thickness of 0.2 mm and formed with square holes having a pitch of 2 mm and each side of 1.8 mm. The second grid 46 is provided at the side of the wire cathode 1, spaced by 5 mm from the third grid 47. Potential of 20 V is applied to a porous cover electrodes 2 and a rear electrode 42, potential of 25 V is appalled to the second grid 46, and potential of 120 V is applied to the third grid 47. Similarly to the embodiment 3 as above described, according to the present embodiment, the distance L is so small that the number of electrons $N_{on}$ reaching the control electrodes 9a which are on is proportional to the range in which the electron current density at the second grid 46 is wide. Such proportionality is available even at the electron current density of 2.0 mA/cm$^2$. The effect of the third grid 47 in the embodiment 4 is similar to that of the second grid 46 in the embodiment 3. Accordingly, in order to make the non-uniformity of the electron current so small that the resultant non-uniformity of luminance may not be a problem, it is preferable for the distance L between the third grid 47 and the first control electrode group 9 to be less than two times the pitch of the apertures 7 of the control electrode. Furthermore, it is good enough of the bridge portions 49 of the third grid 47 are provided at the position where no apertures 7 are present. Arrangement of the pitches and the central axes of the holes 27 of the third grid 47 and the apertures 7 of the insulating substrate 8 may be similar to that of the pitches and central axes of the holes 17 of the second grid 46 and the apertures 7 explained with reference to the embodiment 3. According to the embodiment 4, a similar effect to that of the embodiment 2 may be attained only if the second grid 46 is applied with a potential most optimum for uniformity of the electron current and the third grid 47 is applied with a potential most optimum in respect of luminance and power consumption. In this sense, the applying potentials are not limited to those referred above.

Embodiment 5

Figure 8:
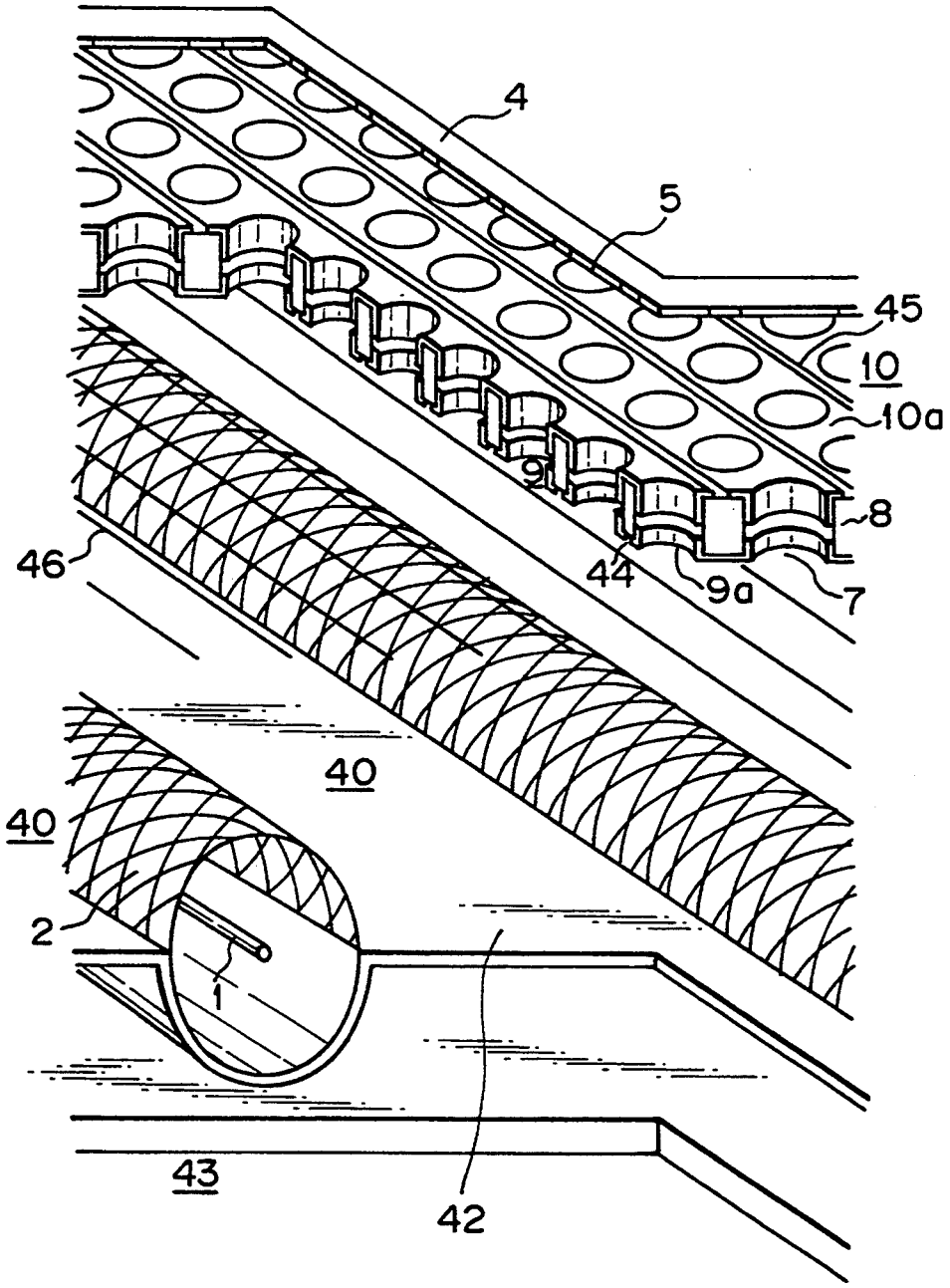
FIG. 8 is a sectional perspective view showing a flat display apparatus according to a still further embodiment of the present invention.
Figure 9:
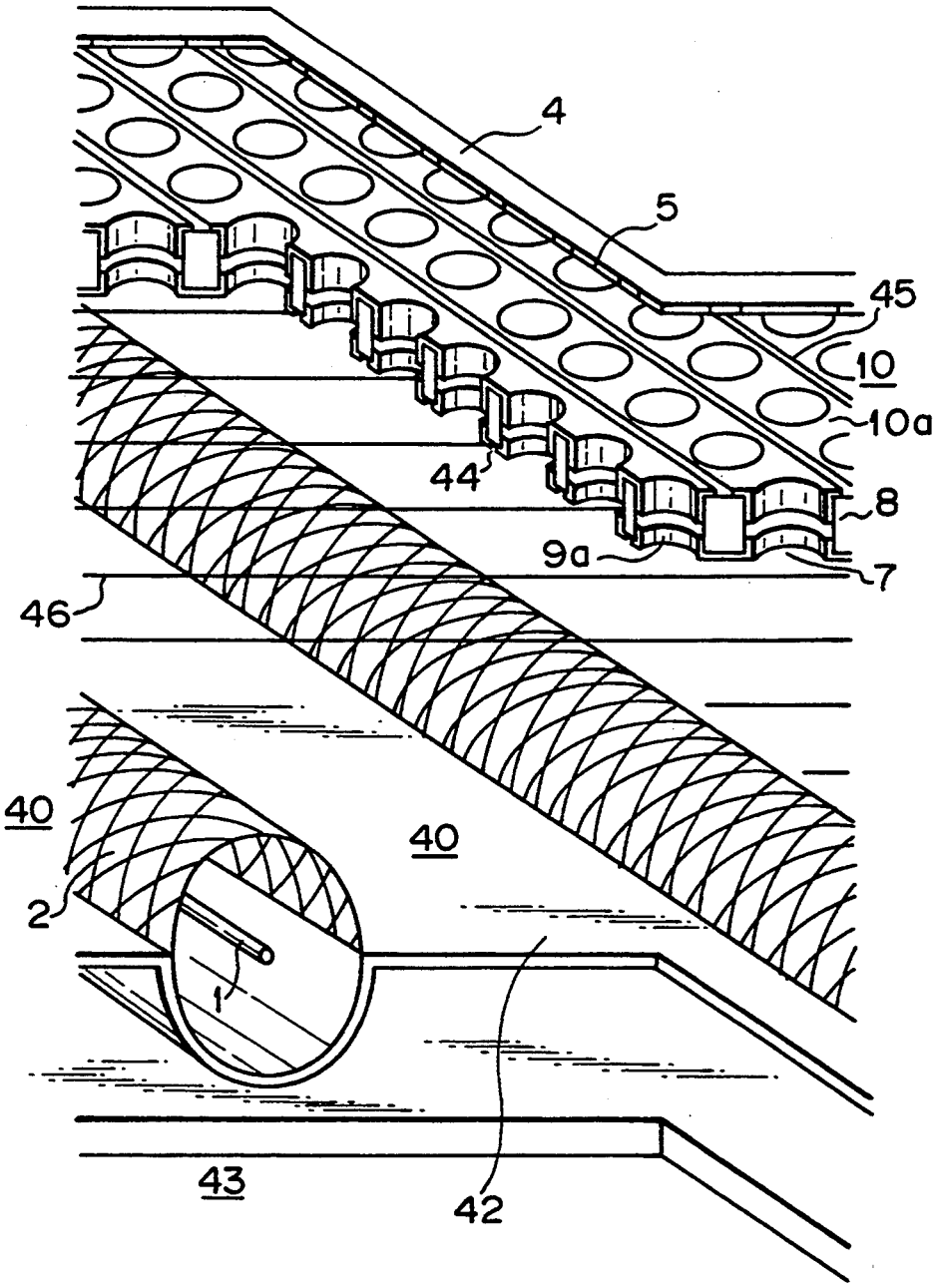
FIG. 9 is a sectional perspective view showing a flat display apparatus according to a further embodiment of the present invention.

FIG. 8 is a sectional perspective view of a part of a flat display apparatus according to a further embodiment of the present invention. Reference numeral 46 designates a second grid made of stainless steel wires having a diameter of 0.05 mm, for example, stretched in parallel having a pitch of 1 mm and an aperture ratio of 95%. The other constitution and the function are similar to those of the embodiment 1. If the apparatus is constituted in this way, there is caused a problem in respect of complicated manufacturing. However, since the aperture rate of the second grid 46 may be increased, the number of electrons absorbed by the second grid 46 may be reduced, such that luminance can be enhanced while the power consumption may be reduced. In this embodiment, although metallic wires are stretched in parallel with the linear hot cathodes 1, a similar effect may be attained if they are stretched perpendicularly to the cathodes 1, as shown in FIG. 9. Also a similar effect may be obtained, if they are stretched slant to the cathodes 1 or if they are woven in two different directions.

Embodiment 6

Figure 10:
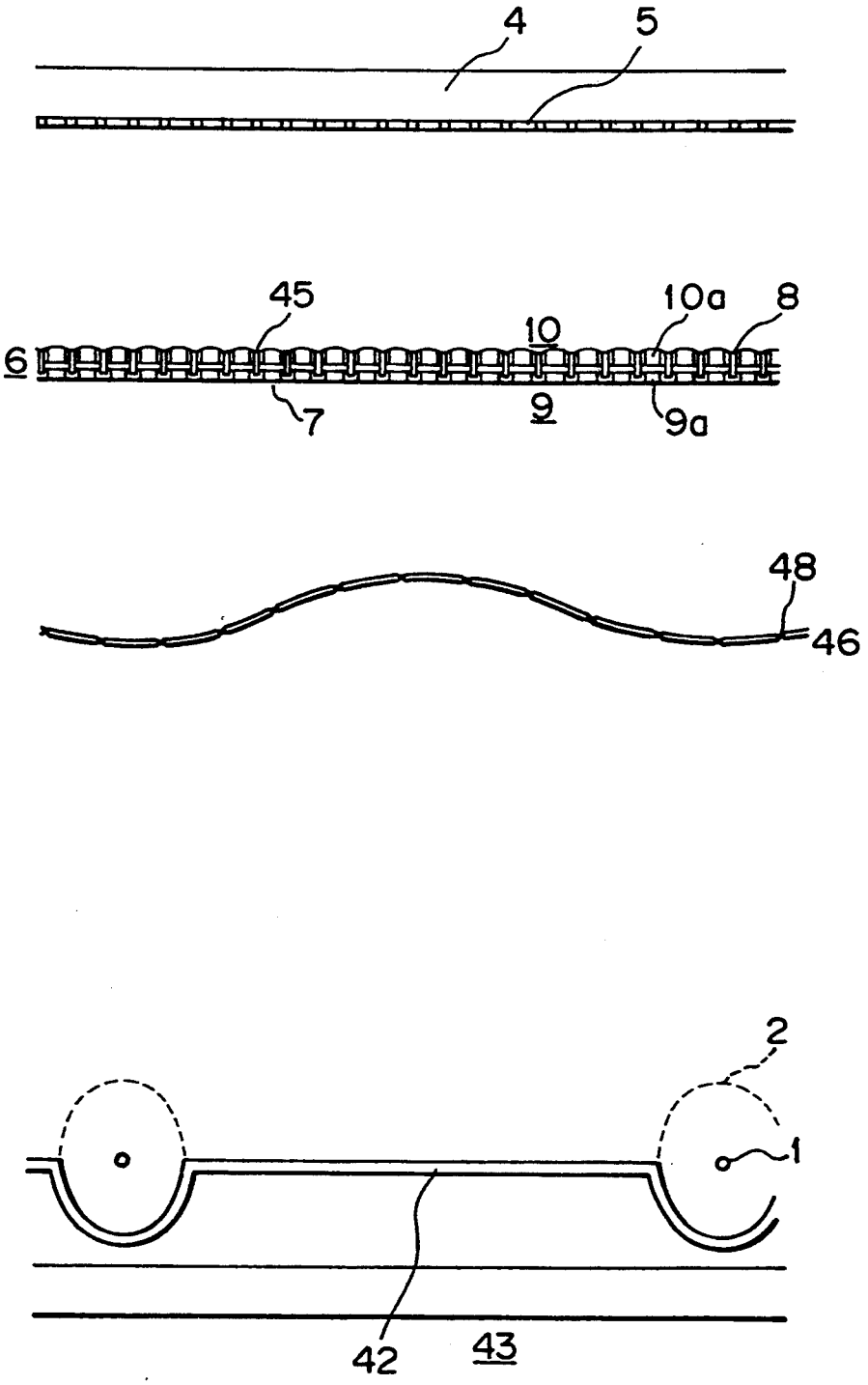
FIG. 10 is a sectional front view showing a flat display apparatus according to a still further embodiment of the present invention.

FIG. 10 is a sectional front view of a portion of a flat display apparatus according to another embodiment of the present invention. The second grid 46 is not planar but is curved toward the side of a porous cover electrode 2 at the portions over the electrode 2. The second grid 46 is curved toward the side of the first control electrode group 9 at the portion over the rear electrode 42 located between the porous cover electrodes 2. According to embodiment 6, the distance between the plane including the rear electrode 42 and the second grid 46 is 12 mm at its minimum and 15 mm at its maximum, and the potentials of the porous cover electrode 2 and the second grid 46 is respectively 20 V and 25 V. As the result, the electrons which are issued to the side surfaces of the porous cover electrode 2 alter their paths to a more vertical direction. Accordingly, after having passed through the second grid 46, the electrons nearly vertically enter the apertures 7 of a control electrode section 6. The more vertically the electrons are incident, the rate of transmission of the electron through the aperture 7 is the higher, accordingly the higher is the luminance. When the electron current density at the front surface of the second grid 46 is 0.45 mA/cm$^2$, the luminance obtained is about 1.4 times as much as that of the embodiment 1.

Embodiment 7

Figure 11:
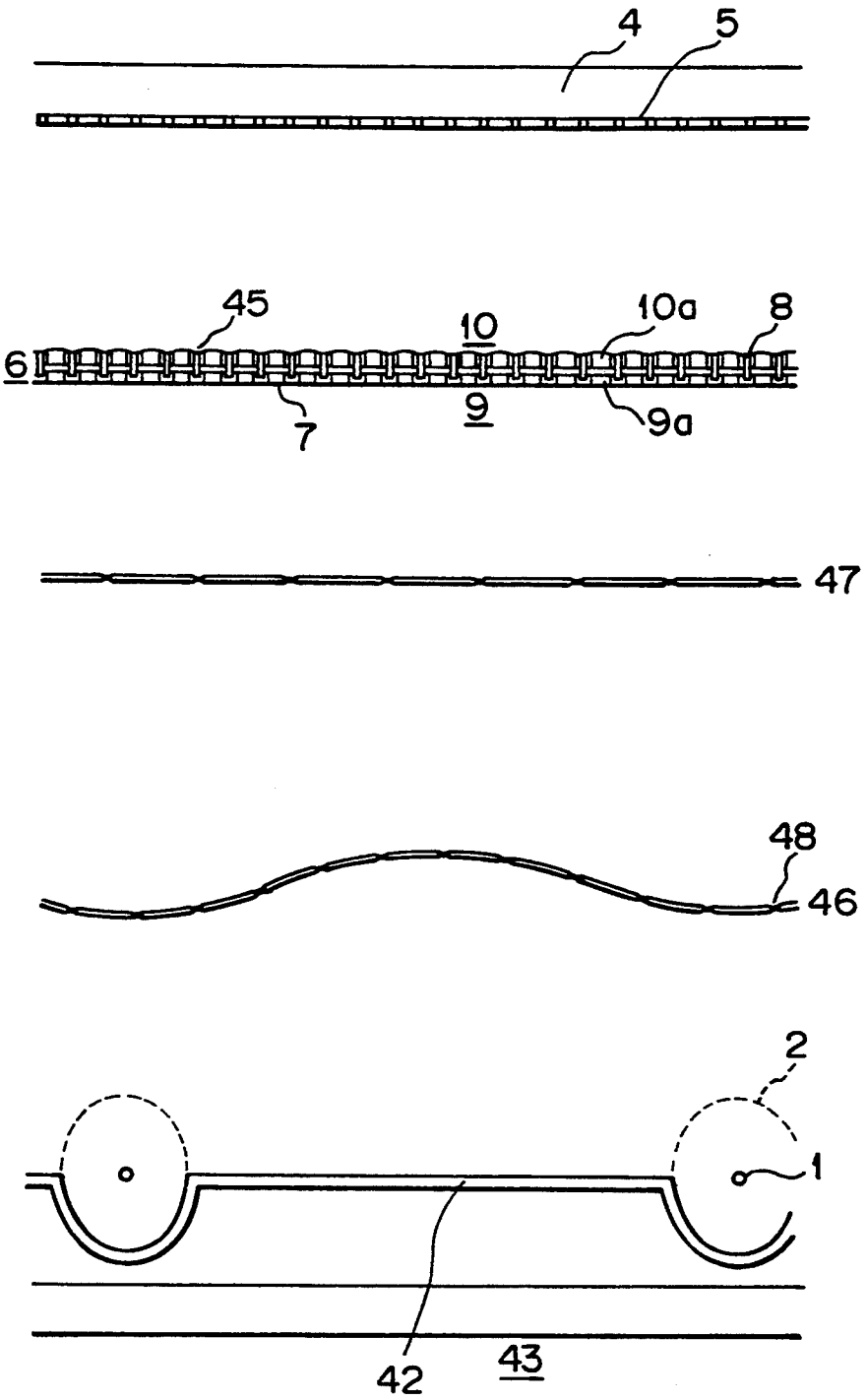
FIG. 11 is a sectional front view showing a flat display apparatus according to a still further embodiment of the present invention.

FIG. 11 is a sectional front view of a portion of a flat display apparatus according to a further embodiment of the present invention. A second grid 46 is not planar but curved toward the porous cover electrode 2 at the portion over the porous cover electrode 2 and curved toward the first control electrode group 9 at the portion over a rear electrode 42 located between the porous cover electrodes 2. In this embodiment, the distance between the plane including the rear electrode 42 and the second grid 46 is 6 mm at its minimum and 9 mm at its maximum. The third grid 47 which is planar is also provided. The distance between the rear electrodes 42 and the third grid 47 is 18 mm while the distance between the rear electrode 42 and the first control electrode group 9 is 23 mm. The potentials of the porous cover electrodes 2, the second grid 46 and the third grid 47 are respectively 20 V, 25 V and 30 V. The path of the electrons which are issued to the side surfaces of the porous cover electrodes 2 is altered to more vertical direction due to the potential of the second grid 46. After having passed through the second grid 46 and the third grid 47, the electrons nearly vertically enter the apertures 7 of the first control electrode group 9 of the control electrode section 6, whereby the transmission rate of the electrodes is enhanced and the luminance is increased similarly to the embodiment 6. According to this embodiment, since the third grid 47 is provided, the flow of electrons is more uniform and the luminance is more uniform than in the case of the embodiment 6.

Embodiment 8

Figure 12:
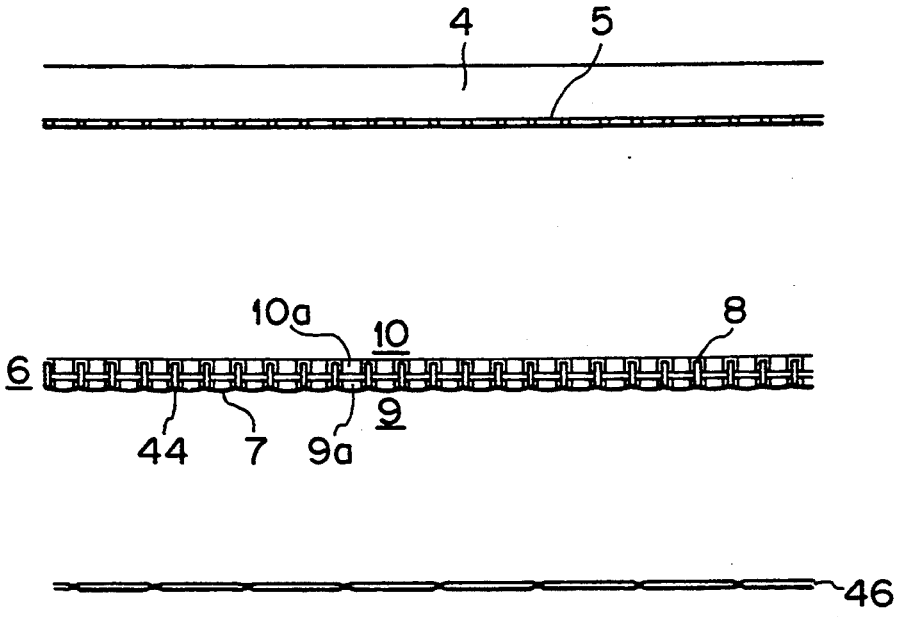
FIG. 12 is a sectional front view showing a flat display apparatus according to a still further embodiment of the present invention.
Figure 12:
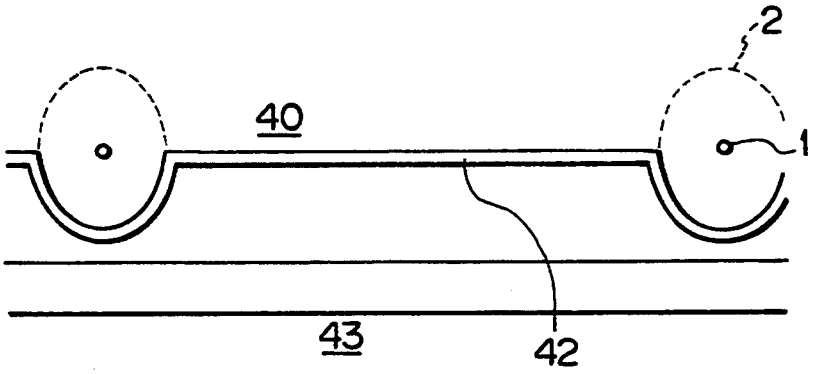
Figure 13:
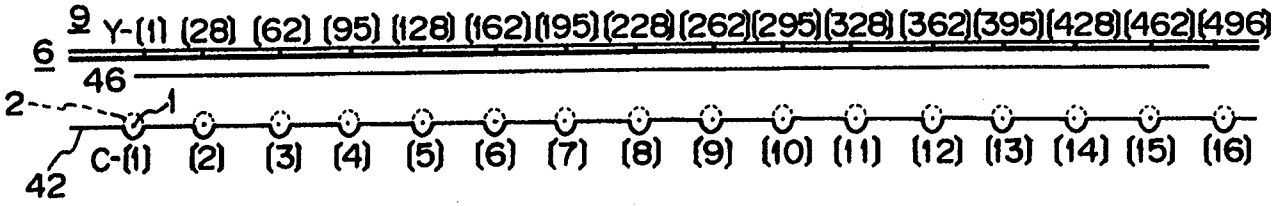
FIG. 13 is a schematic view illustrating the positional relationship between the wire cathodes and the control electrodes of the flat display apparatus shown in FIG. 12.

FIG. 12 is a sectional side view of a part of the flat display apparatus according to a further embodiment of the present invention. The second grid 46 is provided like the embodiment 1. However, conversely to the foregoing embodiments, separation zones 44 as well as metallic electrode 9a of the first control electrode group 9 are disposed in parallel to wire cathodes 1 and separation zones (not shown) as well as the metallic electrodes 10a of the second control electrode group 10 is so arranged as to intersect with the wire cathodes 1. In a similar manner to the foregoing embodiments, scanning is executed by causing each of the respective metallic electrodes 9a of the first control electrode group 9 to be sequentially turned on. Furthermore according to this embodiment, electrons are allowed to be emitted from a few wire cathodes 1 which supply electrons to the metallic electrodes 9a of the first control electrode group 9 being on and which are located nearest to the metallic electrode 9a which is on. For this purpose, the few wire cathodes 1 near the metallic electrode 9a which is on are applied with a potential of −20 V with respect to the potential of the porous cover electrode 2, while the wire cathodes 1 from which electrons cannot reach the metallic electrode 9a which is on, are applied with a potential of 0 V with respect to the potential of the porous cover electrodes 2. The timing of applying potentials in this manner will be explained in detail by referring to FIG. 13 illustrating the positional relationship between the wire cathodes 1 and the respective electrodes 9a of the first control electrode group 9 and FIG. 14 which is the timing chart.

Figure 14:
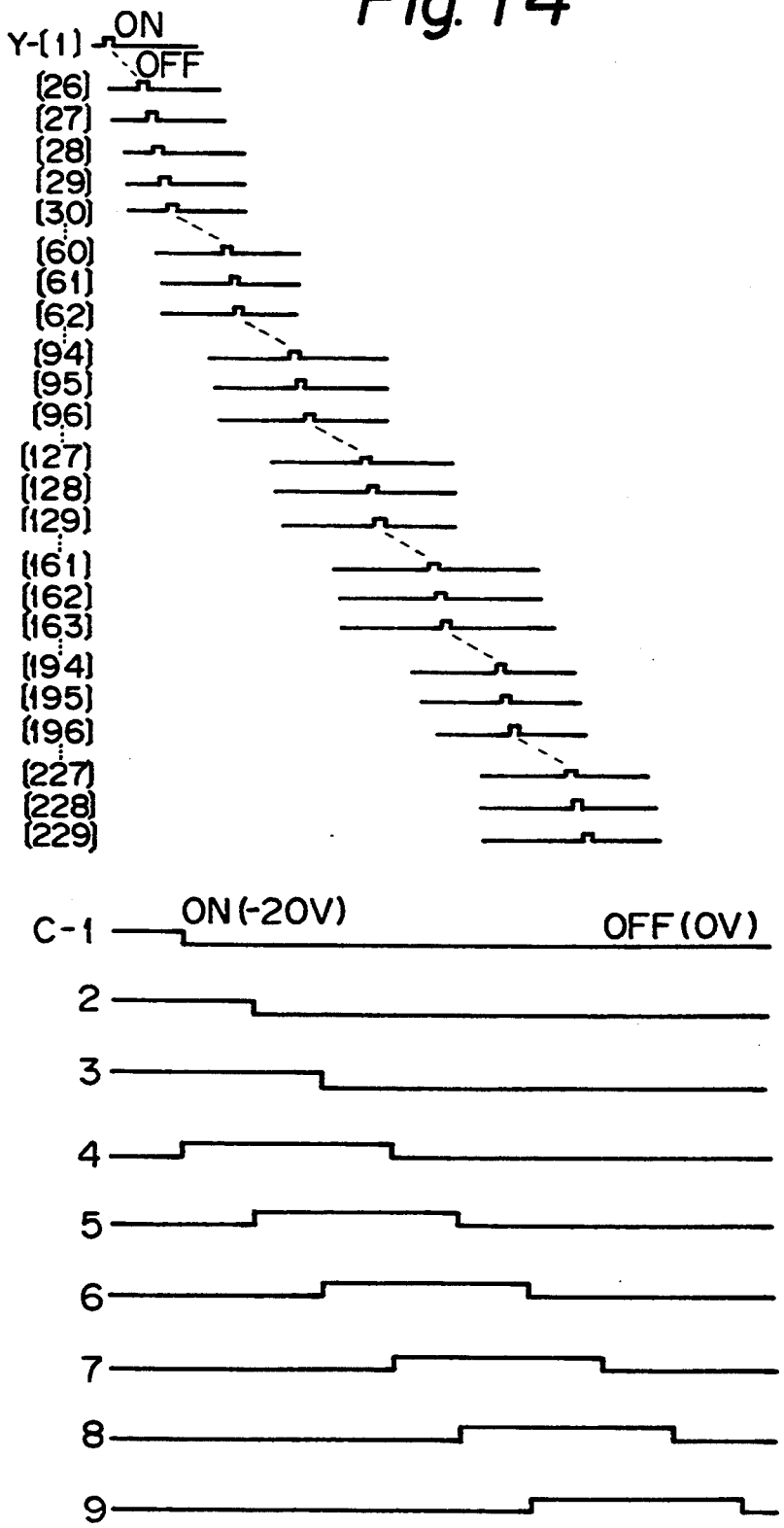
FIG. 14 is a timing chart of the wire cathodes and the control electrodes of the flat display apparatus shown in FIG. 12.

The pitch between the wire cathodes 1 (FIG. 12) is 20 mm and the pitch between the electrodes 9a in the first control electrode group 9 (FIG. 12) is 0.6 mm. The wire cathodes 1 are numbered C-1, C-2,—from the left in FIG. 13 and the metallic electrodes in the first control electrode group 9 are referred to as Y-1, Y-2,—from the left in FIG. 13. No metallic electrode is present immediately above C-1. It is seen from FIG. 13, however, substantially Y-28 corresponds to C-2 and Y-62 corresponds almost to C-3. As shown in FIG. 14, the metallic electrodes are turned on sequentially from Y-1. Correspondingly, while Y-1 through Y-45 (not shown) are on, C-1 is on (potential is −20 V with respect to the porous cover electrode). While Y-1 through Y-78 (not shown) are on, C-2 is on. While substantially from Y-12 through Y-112 (not shown) are on, C-3 is on. The wire cathodes 1 are scanned in such an overlapping manner as three successive wire cathodes 1 are turned on simultaneously as described above.

In the illustrated embodiment, electrons are supplied to any of the apertures only from two of the three wire cathodes 1 and besides, electrons are slightly supplied from the third wire electrode 1. In this embodiment, in order to prevent uneven picture image, electrons are caused to be emitted from three wire cathodes. In this embodiment, there are 16 wire cathodes and since only three cathodes emit electrons, the utilization efficiency of electrons is 16/3 times compared to the embodiment 1. The number of the wire cathodes 1 which are simultaneously turned on depends on how many wire cathodes are caused to supply electrons to one aperture or how much uneven picture image may be allowed and such number may vary from one, two or several of them. Further by varying the voltage to be applied to the wire cathodes 1 which are on with respect to the porous cover electrode 2, unevenness in the picture image may be improved. More specifically, if the luminance above a portion between the wire cathodes is more intense than the one immediately above the wire cathodes, a voltage applied to the wire cathode with respect to the porous cover electrodes 2 corresponding thereto is increased, for example, to −17 V so as to reduce an amount of emitted electrons when the metallic electrodes located above the portion between the wire cathodes are on, whereby a uniform distribution of the electron flow can be attained and uneven picture image may be reduced.

Furthermore in this embodiment, the length of the wire cathodes is almost equal to the length of a side of a picture image. However, even if the wire cathodes are staggered by reducing the length by half, or a fraction, consideration of the positional relationship relative to the metallic electrode of the first control electrode group may be effective if voltages are applied in a similar manner to this embodiment.

Embodiment 9

Figure 15:
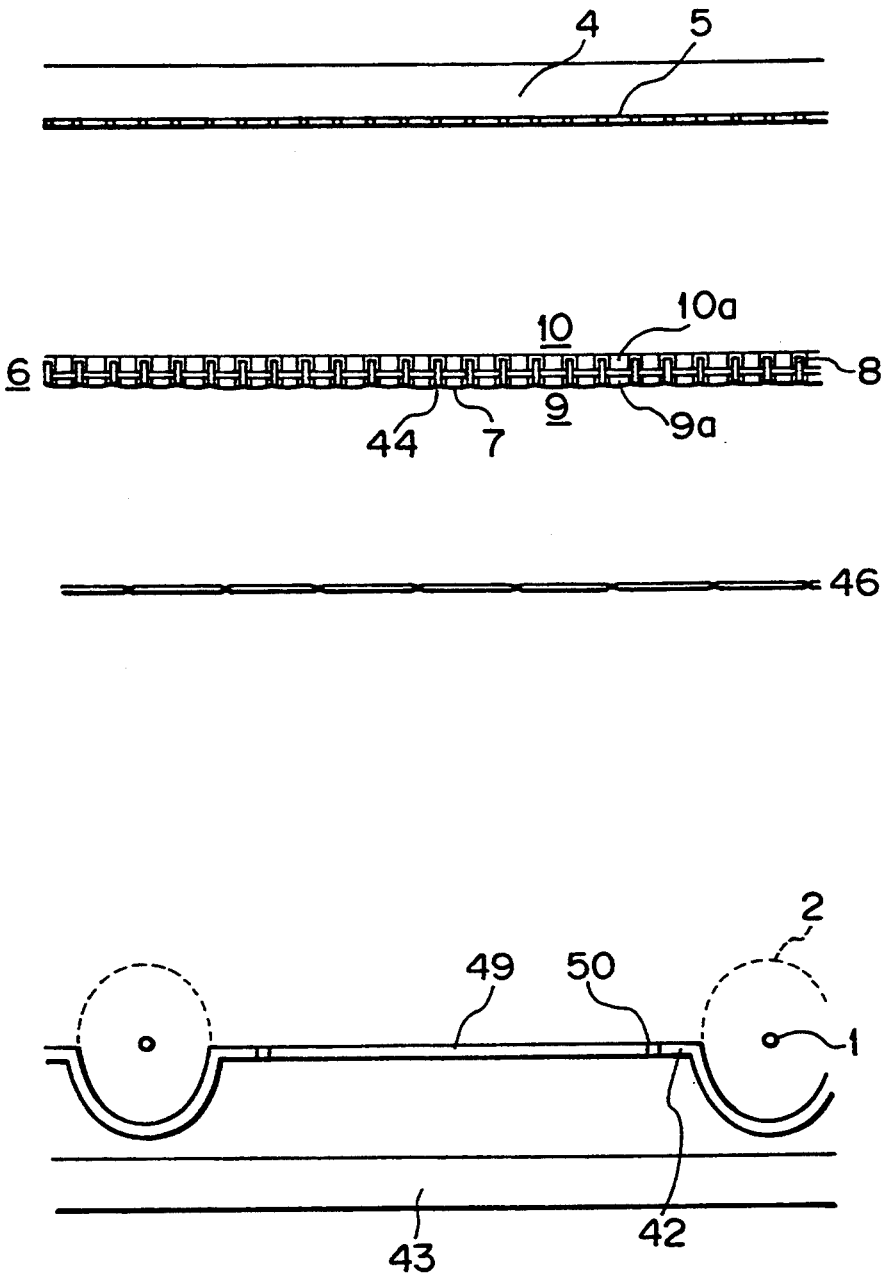
FIG. 15 is a sectional front view showing a flat display apparatus according to a yet further embodiment of the present invention.

FIG. 15 is a sectional side view of a part of the flat display apparatus according to another embodiment of the present invention. Rear electrodes 42 are provided in contact with the porous cover electrodes 2 between the adjacent porous cover electrodes 2. Then rear securing members 50 consisting of an insulating material are connected to the rear electrodes 42 and a second rear electrodes 49 are secured to the securing members 50. The second rear electrode 49 is applied with a lower potential than the one applied to the porous cover electrode 2, or lower by 25 V in this embodiment. The other constitution and operation of the present embodiment are similar to those of the embodiment 8. Further in this embodiment, the path of the electrons which have passed through the porous cover electrodes 2 is changed upwardly as viewed in FIG. 15 due to the lower potential applied to the second rear electrode 49. Since the electrons which have passed through the second grid 46 are incident to the apertures 7 substantially in the vertical direction thereto, the rate of transmission may be increased. In this embodiment, the luminance is as high as 1.7 times as compared to that of the embodiment 8. In this embodiment, the wire cathodes are scanned in a similar manner to that of the embodiment 8. However, a similar effect may be attained even if both of the second grid 46 and the second rear electrodes 49 are provided, without scanning the wire cathodes like in the manner of the embodiment 1.

If the second rear electrode 49 is provided but the second grid is not provided, almost electrodes of the first control electrode group 9 are in OFF condition or the potential thereof is negative. Accordingly, the potential in the entire space between the rear electrode 42 and the control electrode section 6 through which electrons are passing may be lowered due to the second rear electrode 49 applied with lower potential, such that it is difficult for the electrons to reach the apertures 7. As a consequence, any negative effect is reduced by reducing the difference in potential between the second rear electrode 49 and the porous cover electrode 2. As such, combination of the second rear electrode 49 and the second grid 46 is able to provide an outstanding effect.

Embodiment 10

Figure 16:
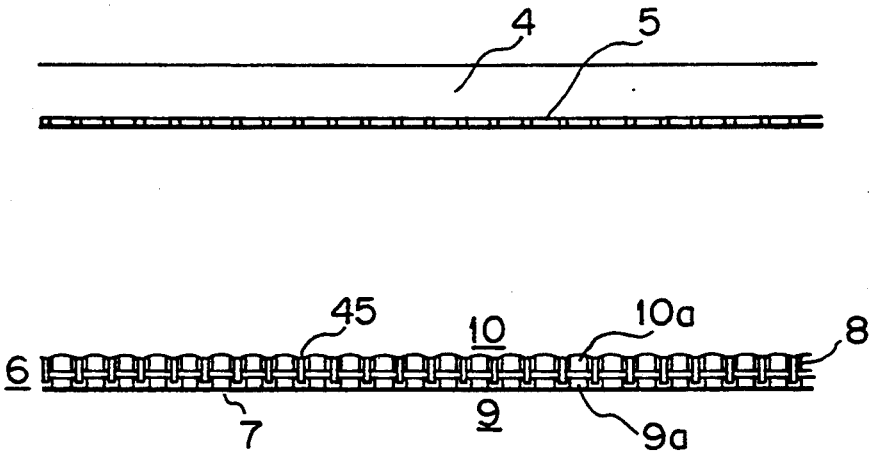
FIG. 16 is a sectional front view showing a flat display apparatus according to a further embodiment of the present invention.
Figure 16:
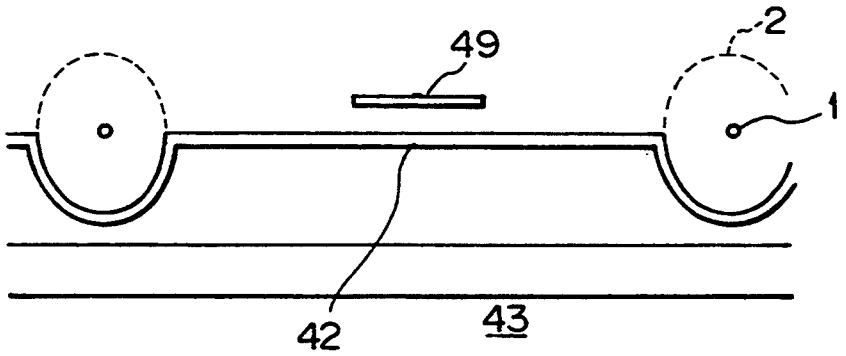

FIG. 16 is a sectional front view of a part of a flat display apparatus of a further embodiment according to the present invention. A rear electrode 42 made of a metallic sheet is provided between the porous cover electrode 2. A second rear electrode 49 is provided between the rear electrode 42 and the first control electrode group 9. The second rear electrode 49 is fixed in the front and in the rear with respect to the drawing of FIG. 16, in the same manner that the wire cathodes 1 are fixed. The second rear electrode 49 is made of a stainless steel sheet having a width of 5 mm and a thickness of 0.5 mm, and spaced by 1 mm from the rear electrode 42. The second rear electrode 49 is applied with a potential lower than the one applied to the porous cover electrodes 2. A potential lower by 10 V is applied in this embodiment. Other constitutions and operations are similar to those of the prior art. In this embodiment, the path of the electrons which have passed through the porous cover electrodes 2 is changed upwardly as viewed in the drawing due to the second rear electrode 49 being applied with a lower potential, and since the electrons are incident to the apertures 7 in a substantially vertical direction thereto, the ratio of transmission may be enhanced. In this embodiment, the luminance may be 1.2 times as intense as the prior art. As compared to the embodiment 9, in this embodiment, no rear securing member in the embodiment 9 which is an insulating body is used, there is no possibility of charging-up, whereby luminance is stable, and also since the porous cover electrodes 2 are connected only by the rear electrode 42 which is a metallic sheet, the entire constitution may be made simple.

Figure 17:
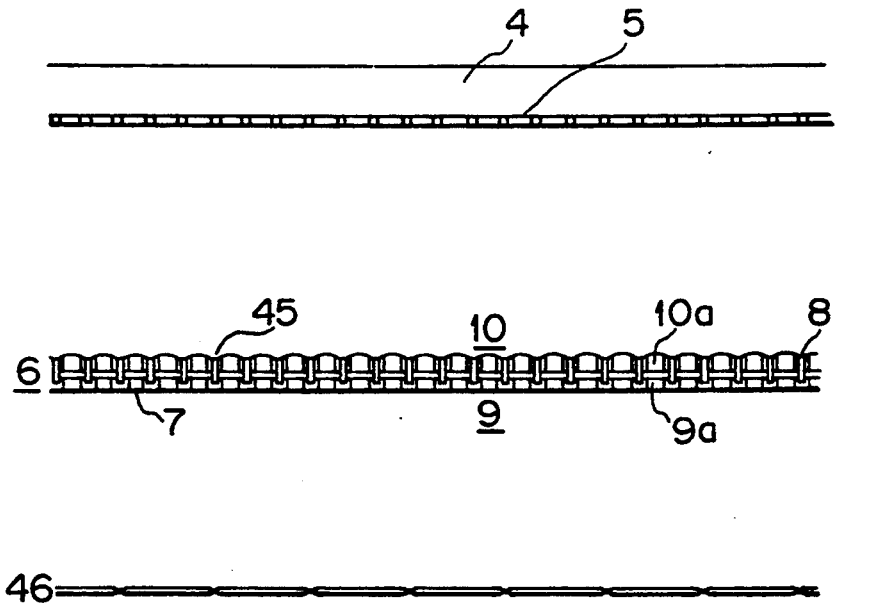
FIG. 17 is a sectional front view showing a flat display apparatus according to a further embodiment of the present invention.
Figure 17:
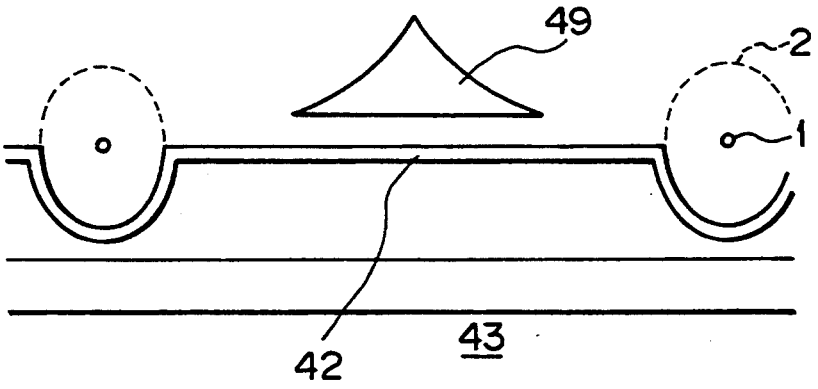
Figure 18:
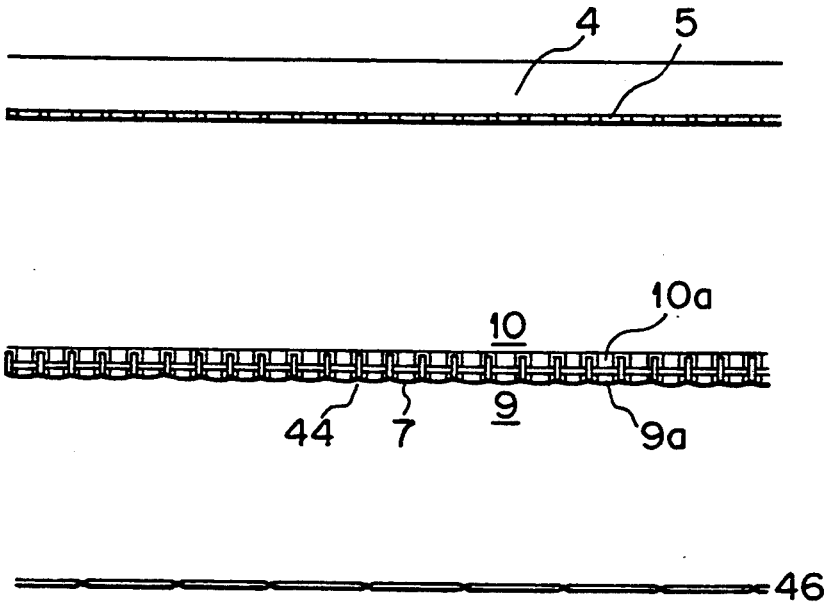
FIG. 18 is a sectional front view showing a flat display .apparatus according to a still further embodiment of the present invention.
Figure 18:
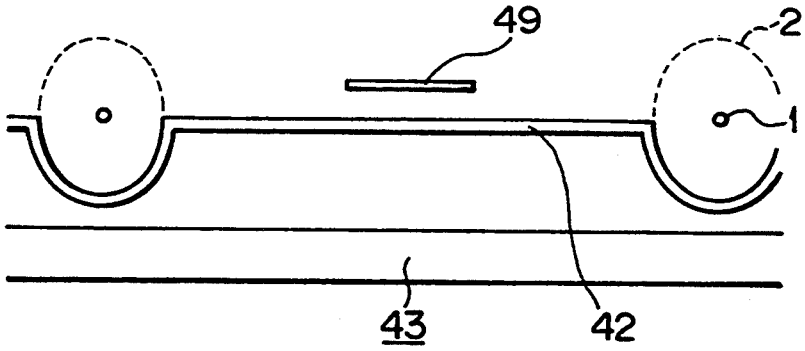

In the embodiment 10 as above described, the effect of the second rear electrode 49 may be attained even if there is no second grid, contrary to the embodiment 9. It is a matter of course that a much better effect may be attained if the second rear electrode is used in combination with the second grid. In this embodiment, the second rear electrode 49 is made of a flat metallic sheet, but it may be made of a metallic electrode having a different configuration, such as a metallic wire. When the second rear electrode is used in combination with the second grid, however, if the area of the second rear electrode is enlarged and the difference in potential between the porous cover electrode and the second rear electrode, uniformity of the electron flow is improved. For example, the second rear electrode may be so configured as shown in FIG. 17 as extend to the control electrode section 6 at the central portion. A similar effect may be attained if the second rear electrode 49 and the second grid 46 are provided as shown in FIG. 18 and also the wire cathodes 1 are scanned.

The present invention has been described in detail with reference to certain preferred embodiments thereof, but it will be understood that variations and modifications can be effected within the spirit and scope of the invention.

What is claimed is:

1. A flat display apparatus comprising:

a sealed container maintained under vacuum, a light emitting means provided in said sealed container, an electron source provided in said sealed container having:

a cathode with a first potential applied thereto, a porous cover electrode for extracting electrons from the cathode, and said electron source emitting the electrons spread toward said light emitting means, a substrate interposed between said porous cover electrode of said electron source and said light emitting means, said substrate including at least an electrically insulated surface, a plurality of apertures allowing a plurality of the electrons emitted from said electron source to pass therethrough, and a plurality of control electrodes which have a passing electron control potential applied thereto for allowing the electrons to selectively pass or not pass through said apertures, in accordance with an operation of the control potential, and an electrically conductive grid means for increasing the uniformity of flow of the plurality of the electrons, said grid means being interposed between and spaced from said control electrodes and said porous cover electrode of said electron source and including a plurality of apertures allowing the electrons emitted from said electron source to pass therethrough, said grid means having a second potential applied thereto, said second potential being higher than said first potential.

2. A flat display apparatus as claimed in claim 1 wherein said apertures of said grid means are positioned such that said apertures of said substrate are included in said apertures of said grid means in the direction from said grid means toward said substrate, and the distance between said control electrodes of said substrate and said grid means is equal to or less than twice of the distance between said adjacent apertures of said substrate.

3. A flat display apparatus as claimed in claim 2 wherein said grid means consists of a plurality of metallic wires.

4. A flat display apparatus as claimed in claim 1 wherein the portion of said grid means in the vicinity of said cathode is curved so as to be convex toward said cathode.

5. A flat display apparatus as claimed in claim 1 wherein said cathode is a wire cathode with a linear shape, a plurality of sets of said cathode and said porous cover electrode are arranged in parallel with one another, said plurality of control electrodes of said substrate are electrically separated from one another, and a part of said control electrodes is arranged in parallel with said wire cathode, and the potential of said wire cathodes with respect to the potential of said porous cover electrodes selectively apply in such a way that electrons are allowed to be emitted from only a few of the wire cathodes the distance of which to the control electrodes which have the passing electron controlling potential out of said part of said control electrodes selectively applied, is nearer.

6. A flat display apparatus as claimed in claim 1 wherein a plurality of sets of said cathodes and said porous cover electrodes are disposed spacedly from one another, additional electrodes electrically insulated from said porous cover electrodes are respectively disposed between the adjacent porous cover electrodes, said additional electrodes having a lower potential applied than the one applied to said porous cover electrodes.

7. A flat display apparatus as claimed in claim 1 wherein a plurality of sets of said cathodes and said porous cover electrodes are disposed spacedly from one another, a rear electrode located between said porous cover electrodes and connecting said plurality of porous cover electrodes, and an additional electrode electrically insulated from said rear electrode and said porous cover electrodes is located in the vicinity of said rear electrodes at the side of said substrate and having a lower potential applied than the one applied to said porous cover electrodes.

8. A flat display apparatus as claimed in claim 1 further including an electrically conductive additional grid means interposed between and spaced from said grid means and said control electrodes, said additional grid means having a plurality of apertures allowing the electrons emitted from said electron source to pass therethrough and having a higher potential applied than the one applied to said cathode.

9. A flat display apparatus as claimed in claim 8 wherein the apertures respectively of said grid means and said additional grid means are positioned in such a manner that the apertures of said substrate are included in the apertures: of said additional grid means in the direction from said grid means and said additional grid means toward said substrate, and the distance between said control electrode of said substrate and said additional grid means is equal to or less than twice of the distance between said adjacent apertures of said substrate.

10. A flat display apparatus as claimed in claim 8 wherein a portion of said grid means in proximity with said cathode is curved to be convex toward said cathode.

11. A flat display apparatus as claimed in claim 8 wherein said cathode is a wire cathode with a linear shape, a plurality of sets of said cathodes and said porous cover electrodes are arranged in parallel with one another, said plurality of control cathodes of said substrate are electrically separated from one another, a part of said control electrodes being disposed in parallel with said wire cathode, the potential of said wire cathodes with respect to the potential of said porous cover electrodes selectively apply in such a way that electrons are allowed to be emitted from only a few of the wire cathodes the distance of which to the control electrodes which have the passing electron controlling potential out of said part of said control electrodes selectively applied is nearer.

12. A flat display apparatus as claimed in claim 8 wherein a plurality of said cathodes are disposed spacedly from one another, a plurality of said porous cover electrodes are disposed spacedly from one another, and additional electrodes electrically insulated from said porous cover electrodes are respectively disposed between the adjacent cover electrodes, said additional electrons have a lower potential applied than the one applied to said porous cover electrodes.

13. A flat display apparatus as claimed in claim 8 wherein a plurality of said cathodes and said porous cover electrodes are disposed spacedly from one another, a rear electrode located between said porous cover electrodes and connecting said plurality of porous cover electrodes, an additional electrode electrically insulated from said rear electrode and said porous cover electrode is located in the vicinity of said rear electrode at the side of said substrate and have a lower potential applied than the one applied to said porous cover electrodes.

14. A flat display apparatus comprising:

a sealed container kept in vacuum, a light emitting means provided in said sealed container, a plurality of electron sources provided spacedly from one another in said sealed container and respectively having a set of:

a cathode, a porous cover electrode for extracting electrons from the cathode, said porous cover electrode having a first potential applied thereto, and said electron sources emitting the electrons spread toward said light emitting means, a rear electrode located between the adjacent porous cover electrodes and connecting said porous cover electrodes to each other, a substrate interposed between said porous cover electrode of said electron source and said light emitting means, said substrate including at least an electrically insulated surface, a plurality of apertures allowing a plurality of the electrons emitted from said electron source to pass therethrough, and a plurality of control electrodes which have the passing electron control potential applied thereto for allowing the electrons to selectively pass or not pass through said apertures, in accordance with an operation of the control potential, and an additional rear electrode for changing the path of a plurality of the electrons, said additional electrode being electrically insulated from said, rear electrode and said porous cover electrodes, said additional electrode having a second potential applied thereto, said second potential being lower than said first potential, said additional electrode being located between said rear electrode and said control electrodes.

15. A flat display apparatus comprising:

a sealed container maintained under vacuum, a light emitting means provided in said sealed container, an electron source provided in said sealed container having:

a cathode with a first potential applied thereto, a porous cover electrode for extracting electrons from the cathode, and said electron source emitting the electrons spread toward said light emitting means, a substrate interposed between said porous cover electrode of said electron source and said light emitting means, said substrate including at least an electrically insulated surface, a plurality of apertures allowing a plurality of the electrons emitted form said electron source to pass therethrough, and a plurality of control electrodes which have a passing electron control potential applied thereto for allowing the electrons to selectively pass or not pass through said apertures, in accordance with an operation of the control potential, and an electrically conductive grid means for increasing the uniformity of flow of the plurality of the electrons, said grid means being interposed between and spaced from said control electrodes and said porous cover electrode of said electron source and including a plurality of apertures allowing the electrons emitted form said electron source to pass therethrough, said grid means having a second potential applied thereto, said second potential being higher than said first potential, and wherein said cathode is a wire cathode with a linear shape, and said porous cover electrode is curved in a concave shape toward said linear wire cathode.

16. A flat display apparatus as claimed in claim 15 wherein said porous cover electrode covers said linear wire cathode at the upper half side which is located toward said substrate in the cross-section of said linear wire cathode.

17. A flat display apparatus as claimed in claim 16 wherein said porous cover electrode has a shape of a half oval or a half circle in the cross-section of said porous cover electrode.

18. A flat display apparatus as claimed in claim 14 wherein said cathode is a wire cathode with a linear shape, and said porous cover electrode is curved in a concave shape toward said linear wire cathode.

19. A flat display apparatus as claimed in claim 18 wherein said porous cover electrode covers said linear wire cathode at the upper half side which is located toward said substrate in the cross-section of said linear wire cathode.

20. A flat display apparatus as claimed in claim 19 where said porous cover electrode has a shape of a half oval or a half circle in the cross-section of said porous cover electrode.

* * * * *